US009462383B2

(12) United States Patent
Okimoto et al.

(10) Patent No.: US 9,462,383 B2
(45) Date of Patent: Oct. 4, 2016

(54) AUDIO SIGNAL PROCESSING DEVICE AND AUDIO SIGNAL PROCESSING METHOD

(71) Applicant: SONY CORPORATION, Tokyo (JP)

(72) Inventors: Koyuru Okimoto, Tokyo (JP); Yuuji Yamada, Tokyo (JP)

(73) Assignee: SONY CORPORATION, Tokyo (JP)

( * ) Notice: Subject to any disclaimer, the term of this patent is extended or adjusted under 35 U.S.C. 154(b) by 23 days.

(21) Appl. No.: 14/538,171

(22) Filed: Nov. 11, 2014

(65) Prior Publication Data

US 2015/0139443 A1 May 21, 2015

(30) Foreign Application Priority Data

Nov. 21, 2013 (JP) ..... 2013-241398

(51) Int. Cl.

| | |
|---|---|
| ***H04S 3/00*** | (2006.01) |
| ***H04R 3/12*** | (2006.01) |
| ***H04S 1/00*** | (2006.01) |
| *H04R 5/02* | (2006.01) |

(52) U.S. Cl.

CPC ..... *H04R 3/12* (2013.01); *H04S 1/002* (2013.01); *H04R 5/02* (2013.01); *H04R 2430/00* (2013.01); *H04R 2499/13* (2013.01); *H04S 3/00* (2013.01); *H04S 2400/05* (2013.01)

(58) Field of Classification Search

CPC ..... H04R 2499/13; H04R 5/02; H04R 3/12; H04S 2400/05; H04S 3/00

USPC ..... 381/302–303, 27, 86, 97–98, 300

See application file for complete search history.

(56) References Cited

U.S. PATENT DOCUMENTS

| | | | | |
|---|---|---|---|---|
| 5,297,209 | A * | 3/1994 | Kowaki | H04S 5/00 381/10 |
| 5,426,702 | A * | 6/1995 | Aarts | H04S 5/00 381/22 |
| 2004/0184628 | A1* | 9/2004 | Nakamichi | H04R 5/02 381/302 |
| 2005/0213786 | A1* | 9/2005 | Kerneis | H04R 5/02 381/302 |
| 2006/0045291 | A1* | 3/2006 | Smith | H04S 7/30 381/119 |

FOREIGN PATENT DOCUMENTS

JP 2009-055079 A 3/2009

* cited by examiner

*Primary Examiner* — Disler Paul
(74) *Attorney, Agent, or Firm* — Chip Law Group

(57) ABSTRACT

There is provided an audio signal processing device for setting, upon outputting audio signals from a left speaker and a right speaker each having an identical amplitude-frequency characteristic and a phase characteristic, and from one center speaker arranged between the left speaker and the right speaker, listening points between the left speaker and the center speaker and between the right speaker and the center speaker, the audio signal processing device including an inverse filter processing unit configured to provide inverse characteristics of an amplitude-frequency characteristic and a phase characteristic of the center speaker, and a speaker characteristic adding processing unit configured to correct the amplitude-frequency characteristic and the phase characteristic of an audio signal of the center speaker that have been processed by the inverse filter processing unit in a manner that they correspond to characteristics of the left speaker and the right speaker.

9 Claims, 17 Drawing Sheets

AUDIO SIGNAL PROCESSING DEVICE AND AUDIO SIGNAL PROCESSING METHOD

CROSS REFERENCE TO RELATED APPLICATIONS

This application claims the benefit of Japanese Priority Patent Application JP 2013-241398 filed Nov. 21, 2013, the entire contents of which are incorporated herein by reference.

BACKGROUND

The present disclosure relates to an audio signal processing device and audio signal processing method for processing an input audio signal.

In a sound reproduction system that reproduces an audio signal and outputs it from a speaker, it is desirable to produce a sound field having a sense of reality with higher sound quality. In this case, the processing of an audio signal depending on the constraints of the sound reproduction system itself or the conditions of a space where the sound reproduction system is installed makes it possible to provide a more optimum sound reproduction space.

For example, JP 2009-055079A discloses a technology that controls the adjustment of both the amount of boost of a low-frequency band and the level of a harmonic signal depending on the detected level of the low-frequency band signal to achieve reproduction of bass tones having increased bass fullness with favorable sound quality even by a compact speaker system. In addition, for example, in a sound reproduction system in interior space of a vehicle, there is intended to achieve improvement in sound quality using an equalizer for sound quality adjustment that employs an infinite impulse response (IIR) filter or using a time alignment function that adjusts output time of sound output from each speaker.

SUMMARY

In the above-described technology, it is possible to align approximately the arrival time of sound from each speaker to a listening point or the level of sound arriving at a listening point. However, if a sound reproduction system is configured to include a plurality of different types of speakers, the arrival time of sound varies with their frequencies, and phase characteristics at a plurality of listening points will be disturbed, resulting in becoming a reproduction space in which sound localization is unstable.

For example, in an in-vehicle space, when a sound reproduction system is configured to include two door speakers, if the time alignment adjustment is performed separately for each door speaker, it is possible to align the time at which a reproduced sound first arrives at any one seat of a driver's seat and a front passenger seat. However, the arrival time of sound over the entire frequency range is not aligned, and thus enhanced sound localization may not be achieved. Furthermore, the time at which a reproduced sound first arrives at the other seat is not aligned. In this way, phase control is not achieved even by adjusting the amplitude-frequency characteristics using an IIR filter, and thus enhanced sound localization may not be achieved.

Moreover, for example, in the internal space of a vehicle provided with two door speakers and one center speaker, it is possible to align the time at which a reproduced sound first arrives by performing the time alignment adjustment between the center speaker and the door speakers. However, also in this case, the arrival time of sound over the entire frequency range is not aligned, and thus enhanced sound localization may not be achieved. Phase control is not achieved even by adjusting amplitude-frequency characteristics using an IIR filter, and thus enhanced sound localization may not be achieved.

Thus, it is desirable, in a space at which a plurality of speakers having different characteristics are arranged, to allow all the frequencies included in a reproduced sound to arrive from the respective speakers to a plurality of listening points substantially simultaneously at the same level, thereby achieving enhanced sound localization at each listening point simultaneously.

According to an embodiment of the present disclosure, there is provided an audio signal processing device for setting, upon outputting audio signals from a left speaker and a right speaker each having an identical amplitude-frequency characteristic and a phase characteristic, and from one center speaker arranged between the left speaker and the right speaker, listening points between the left speaker and the center speaker and between the right speaker and the center speaker, the audio signal processing device including an inverse filter processing unit configured to provide inverse characteristics of an amplitude-frequency characteristic and a phase characteristic of the center speaker, and a speaker characteristic adding processing unit configured to correct the amplitude-frequency characteristic and the phase characteristic of an audio signal of the center speaker that have been processed by the inverse filter processing unit in a manner that the processed amplitude-frequency characteristic and the processed phase characteristic correspond to characteristics of the left speaker and the right speaker.

According to an embodiment of the present disclosure, the amplitude-frequency and phase characteristics of a center speaker are corrected to be the same as characteristics of each of left and right speakers. Thus, it is possible to allow all the frequencies included in a reproduced sound to arrive from a plurality of speakers having different characteristics to a plurality of listening points substantially simultaneously at the same level, thereby achieving enhanced sound localization at each listening point simultaneously.

According to another embodiment of the present disclosure, there is provided an audio signal processing method for setting, upon outputting audio signals from a left speaker and a right speaker each having an identical amplitude-frequency characteristic and phase characteristic, and from one center speaker arranged between the left speaker and the right speaker, listening points between the left speaker and the center speaker and between the right speaker and the center speaker by an audio information processing device, the audio signal processing method including providing inverse characteristics of an amplitude-frequency characteristic and a phase characteristic of the center speaker, and correcting an amplitude-frequency characteristic and a phase characteristic of an audio signal of the center speaker provided with the inverse characteristics in a manner that the amplitude-frequency characteristic and the phase characteristic of the audio signal of the center speaker correspond to characteristics of the left speaker and the right speaker.

According to one or more embodiments of the present disclosure as described above, it is possible to allow all the frequencies included in the reproduced sound to arrive from a plurality of speakers having different characteristics to a plurality of listening points substantially simultaneously at the same level, thereby achieving enhanced sound localization at each listening point simultaneously. Note that the advantages described above are not necessarily intended to be restrictive, and any other advantages described herein and other advantages that will be understood from the present disclosure may be achievable, in addition to or as an alternative to the advantages described above.

DETAILED DESCRIPTION OF THE EMBODIMENT(S)

Figure 1:
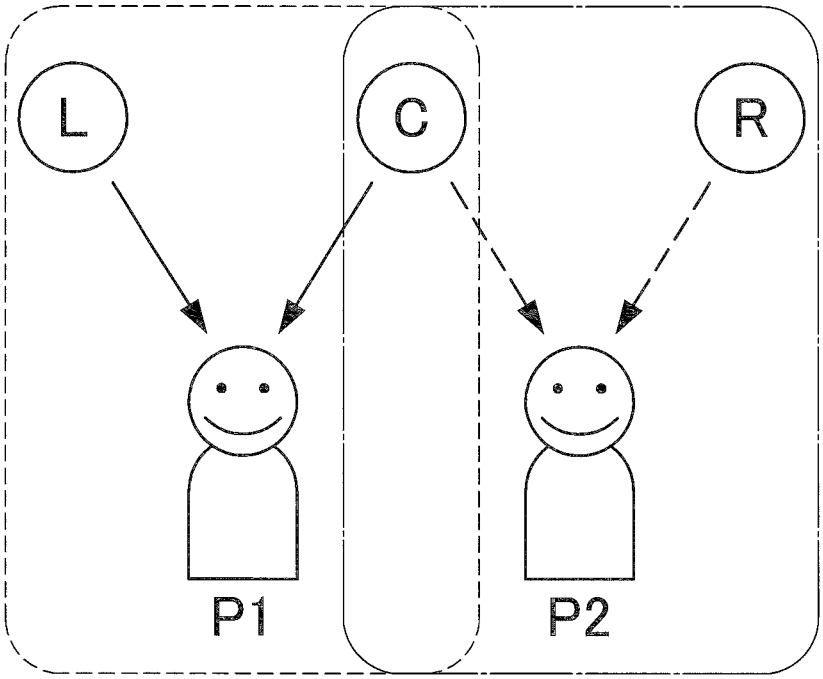
FIG. 1 is a diagram for describing an overview of an audio signal process according to an embodiment of the present disclosure.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

The description will be made in the following order.

0. Overview
1. First Embodiment (three speakers, correction of only center speaker)
1.1. Arrangement of Speaker
1.2. Audio Signal Processing Device
1.3. Audio Signal Processing Method
1.4. Example (correction of acoustic characteristics by audio signal processing device)
2. Second Embodiment (three speakers, correction of each speaker)
2.1. Audio Signal Processing Device
2.2. Audio Signal Processing Method
2.3. Example (correction of acoustic characteristics by audio signal processing device)
3. Third Embodiment (five speakers)
3.1. Arrangement of Speaker
3.2. Audio Signal Processing Device
3.3. Audio Signal Processing Method
3.4. Example (correction of acoustic characteristics by audio signal processing device)
4. Fourth Embodiment (seven speakers)
4.1. Arrangement of Speaker
4.2. Audio Signal Processing Device
4.3. Audio Signal Processing Method
4.4. Example (correction of acoustic characteristics by audio signal processing device)
5. Conclusion

0. Overview

Referring now to FIG. 1, an overview of an audio signal process according to an embodiment of the present disclosure is described. FIG. 1 is a diagram for describing an overview of an audio signal process according to an embodiment of the present disclosure.

An embodiment of the present technology is intended, in a space such as indoor space and in-vehicle space in which a plurality of speakers having different characteristics are arranged, to provide enhanced sound localization of a reproduced sound that is output from each speaker at a plurality of listening points in the space simultaneously. For example, as illustrated in FIG. 1, it is assumed that three speakers including a center speaker C, a left speaker L, and a right speaker R are arranged in a space. The left and right speakers are arranged on the left and right, respectively, with respect to the center speaker C. The left and right speakers L and R have the same amplitude-frequency and phase characteristics.

In such a space, it is assumed that a listener listens to the reproduced sound that is output from each speaker at a position P1 between the left speaker L and the center speaker C and at a position P2 between the right speaker R and the center speaker C. At the position P1, the reproduced sound coming from the left speaker L and the center speaker C is predominant. At the position P2, the reproduced sound coming from the right speaker R and the center speaker C is predominant. In this time, as in the typical case, if all the frequencies included in the reproduced sound that is output from the respective speakers C, L, and R arrive at the positions P1 and P2 of a listener at different arrival times or different levels, then it is not possible to achieve enhanced sound localization simultaneously at each position.

Thus, in an embodiment of the present technology, an audio signal process is performed so that all the frequencies included in a reproduced sound may arrive at a plurality of listening points substantially simultaneously at the same level. In other words, a signal process is performed so that the reproduced sounds that are output from the center speaker C and the left speaker L may arrive at the position P1 between these speakers C and L substantially simultaneously at the same level. Similarly, a signal process is performed so that the reproduced sounds that are output from the center speaker C and the right speaker R may arrive at the position P2 between these speakers C and R substantially simultaneously at the same level. Accordingly, it is possible to achieve enhanced sound localization at a plurality of listening points simultaneously in the same space.

An embodiment of the present disclosure based on such an audio signal process is described in more detail below. Although a method for processing an audio signal output from a plurality of speakers arranged in an in-vehicle space is described below, the present technology is not limited to this example. For example, the present technology is applicable to cases where a plurality of speakers provided in a television or audio equipment are arranged in an indoor space.

1. First Embodiment

Referring to FIGS. 2 to 7, the configuration of an audio signal processing device according to a first embodiment of the present disclosure and an audio signal process performed therewith are described.

[1.1. Arrangement of Speaker]

Figure 2:
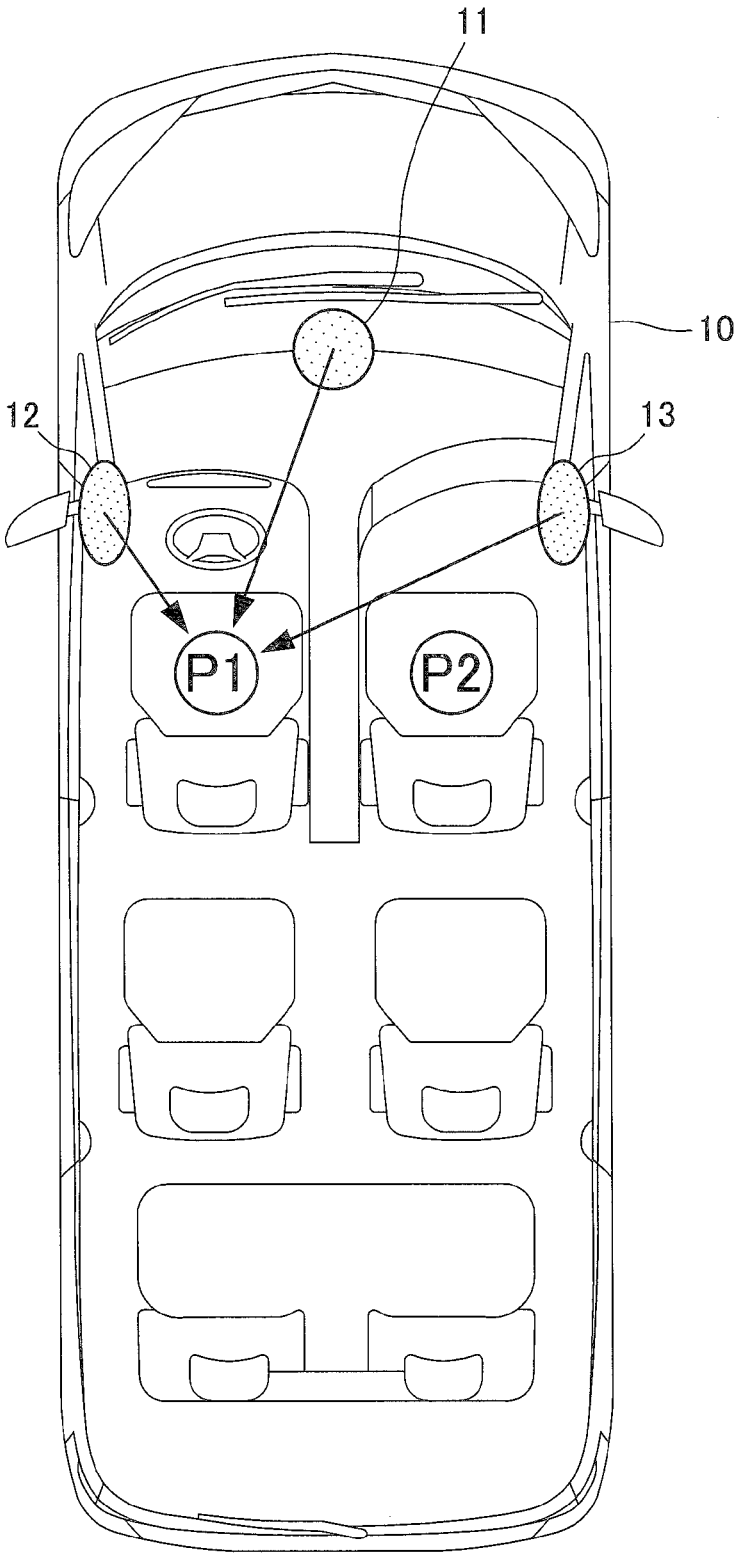
FIG. 2 is a diagram for describing an exemplary arrangement of a speaker in an in-vehicle space according to a first embodiment of the present disclosure.

Referring now to FIG. 2, an exemplary arrangement of a speaker in an in-vehicle space according to the present embodiment is described. FIG. 2 is a diagram for describing an exemplary arrangement of a speaker in an in-vehicle space according to the present embodiment.

In an interior space of a vehicle 10 illustrated in FIG. 2, three speakers that include a center speaker 11, a left door speaker 12, and a right door speaker 13 are provided. The center speaker 11 is provided on a dashboard, the left door speaker 12 is provided in a door on the driver's seat side, and the right door speaker 13 is provided in a door on the front passenger seat side. The center speaker 11 is arranged substantially at the center in the width direction of the vehicle 10 between the left door speaker 12 and the right door speaker 13. The center speaker 11 has a reproduction frequency range of a mid- and high-range, for example, of 300 Hz to 20 kHz. The left door speaker 12 and the right door speaker 13 have the same amplitude-frequency and phase characteristics and they have a reproduction frequency range, for example, of 80 Hz to 20 kHz.

In the present embodiment, it is assumed that the vicinity of a headrest of the driver's seat is set as a listening point P1 and the vicinity of a headrest of the front passenger seat is set as a listening point P2. In order to obtain enhanced sound localization simultaneously at the listening points P1 and P2, the respective speakers output a reproduced sound after an audio signal process to be described later is performed by an audio signal processing device 100. The audio signal processing device 100 performs a signal process so that all the frequencies included in a reproduced sound coming from the respective speakers may arrive at the respective listening points simultaneously at the same level.

It is considered that the reproduced sound which is heard at the listening points P1 and P2 in the vicinity of headrests of the driver's seat and the front passenger seat has the following configuration. The two reproduced sounds coming from the center speaker 11 and the door speaker 12 (or 13) in the vicinity of the listening point P1 (or P2) are predominant in a reproduction frequency range of 300 Hz to 20 kHz. For example, when a reproduced sound is heard at the driver's seat, the reproduced sounds that are output from the center speaker 11 and the left door speaker 12 are predominant. When a reproduced sound is heard at the front passenger seat, the reproduced sound that are output from the center speaker 11 and the right door speaker 13 are predominant. When a reproduced sound has a frequency range of less than or equal to 300 Hz, the reproduced sound is outside the reproduction frequency range of the center speaker 11, and thus reproduced sounds coming from the left door speaker 12 and the right door speaker 13 are heard at the respective listening points P1 and P2.

In order to obtain enhanced sound localization simultaneously at the driver's seat and the front passenger seat, it is necessary to allow the respective frequencies included in the reproduced sounds coming from the speakers 11, 12, and 13 to arrive at the listening point P1 on the driver's seat side and at the listening point P2 on the front passenger seat side simultaneously at the same level. In other words, in a reproduction frequency range of 300 Hz to 20 kHz, the reproduced sounds coming from the center speaker 11 and the door speaker 12 (or 13) in the vicinity of the listening point P1 (or P2) are allowed to arrive at the respective listening points simultaneously at the same level. When a reproduced sound has a frequency range of less than or equal to 300 Hz, the reproduced sounds coming from the left door speaker 12 or the right door speaker 13 are allowed to arrive at the respective listening points P1 and P2 simultaneously at the same level.

In this regard, in interior space of a general vehicle, the difference between the distance from the left door speaker 12 to a listener and the distance from the right door speaker 13 to the listener is in the range of approximately 30 to 40 cm. If it is assumed that the speed of sound is set to 340 m/s, the difference in distance corresponds to the length of a half-wavelength of 425 to 570 Hz. In other words, a reproduced sound having a low-frequency range that is less than or equal to the range of 425 to 570 Hz from the left door speaker 12 or the right door speaker 13 is allowed to arrive at the respective listening points P1 and P2 with a delay of half-wavelength ($\lambda/2$) or less. In this case, as the reproduction frequency range becomes lower, the effect of phase deviation on the reproduced sound at the listening points P1 and P2 decreases. On the other hand, when a reproduced sound has a mid- and high-frequency range greater than or equal to the range of 425 to 570 Hz that is output from the left door speaker 12 or the right door speaker 13, the frequencies arriving at the listening points P1 and P2 are deviated from each other by a half-wavelength or more, resulting in no contribution to implementation of stable localization.

Thus, in the audio signal processing device 100 according to the present embodiment, when a reproduced sound has a mid- and high-frequency range, the characteristics of the center speaker 11 observed at the listening points P1 and P2 are corrected to be closer to characteristics of the left door speaker 12 and the right door speaker 13. As a result, the characteristics of the center speaker 11 are allowed to match the characteristics of the door speakers 12 and 13 in the reproduction frequency range of 300 Hz to 20 kHz, and thus it is possible to align the arrival time and reproduction level of a reproduced sound at the listening points P1 and P2.

[1.2. Audio Signal Processing Device]

Figure 3:
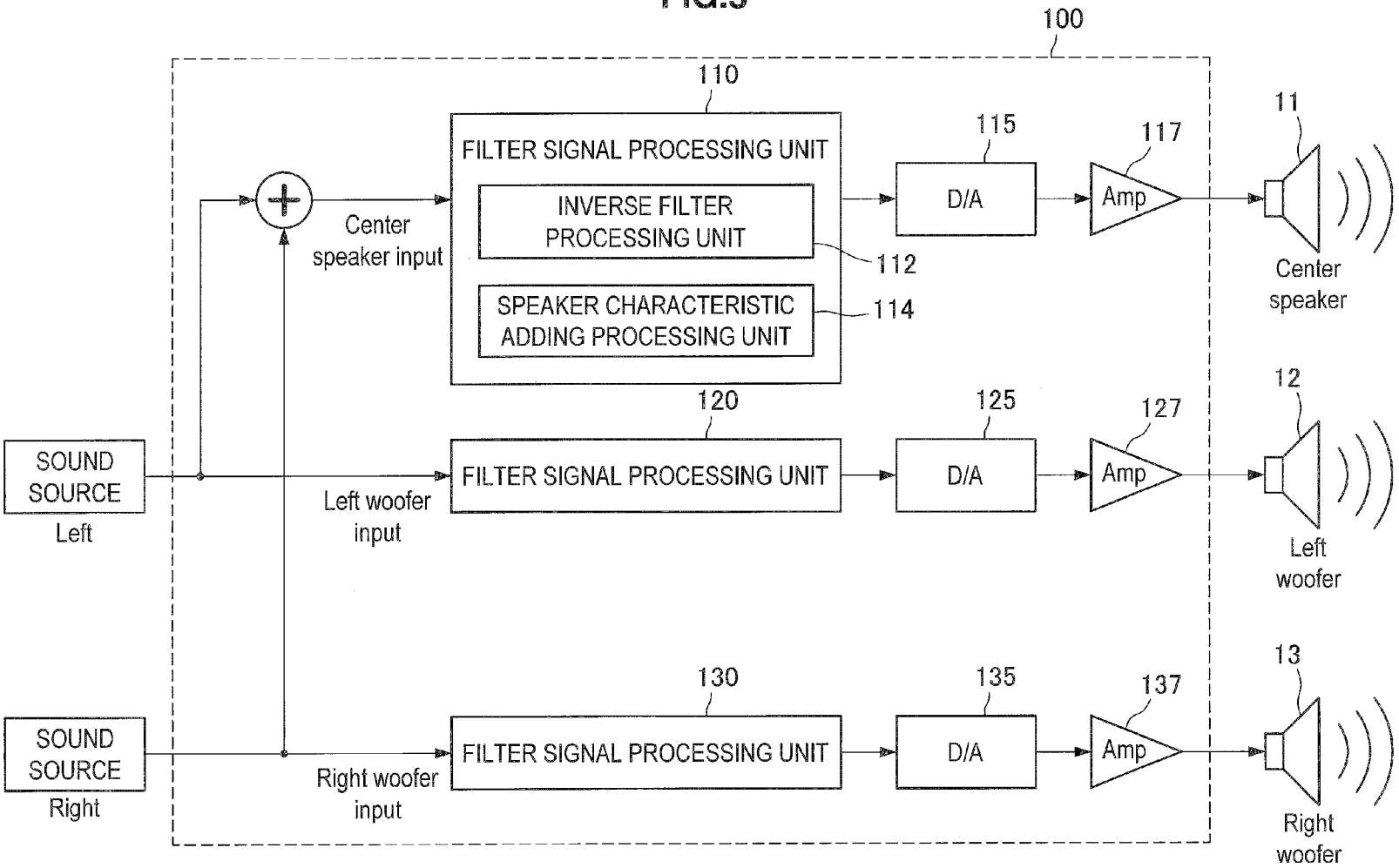
FIG. 3 is a block diagram illustrating the configuration of an audio signal processing device according to the first embodiment.

FIG. 3 illustrates the configuration of the audio signal processing device 100 according to the present embodiment. The present embodiment illustrates a case where stereo (or stereophonic) reproduction that reproduces two-channel sound is performed. In addition, in the present embodiment, although the description is based on a case where an input signal is a digital signal, the description can be similarly applied to an analog audio signal by performing an A/D conversion process before filter signal processing units 110, 120, and 130 perform their processes.

The audio signal processing device 100 is configured to include filter signal processing units 110, 120 and 130, D/A converters 115, 125 and 135, and power amplifiers 117, 127 and 137, for the respective speakers 11, 12 and 13, as illustrated in FIG. 3.

The filter signal processing units 110, 120, and 130 perform a predetermined signal process on an input digital audio signal. The sum of two left and right channel sound sources LEFT and RIGHT is input to the filter signal processing unit 110 that performs processing of a reproduced sound that is output from the center speaker 11. In the present embodiment, the filter signal processing unit 110 corrects the characteristics of a reproduced sound that is output from the center speaker 11 to be close to the characteristics of the left door speaker 12 and the right door speaker 13. For this reason, the filter signal processing unit 110 is configured to include an inverse filter processing unit 112 and a speaker characteristic adding processing unit 114.

Figure 4:
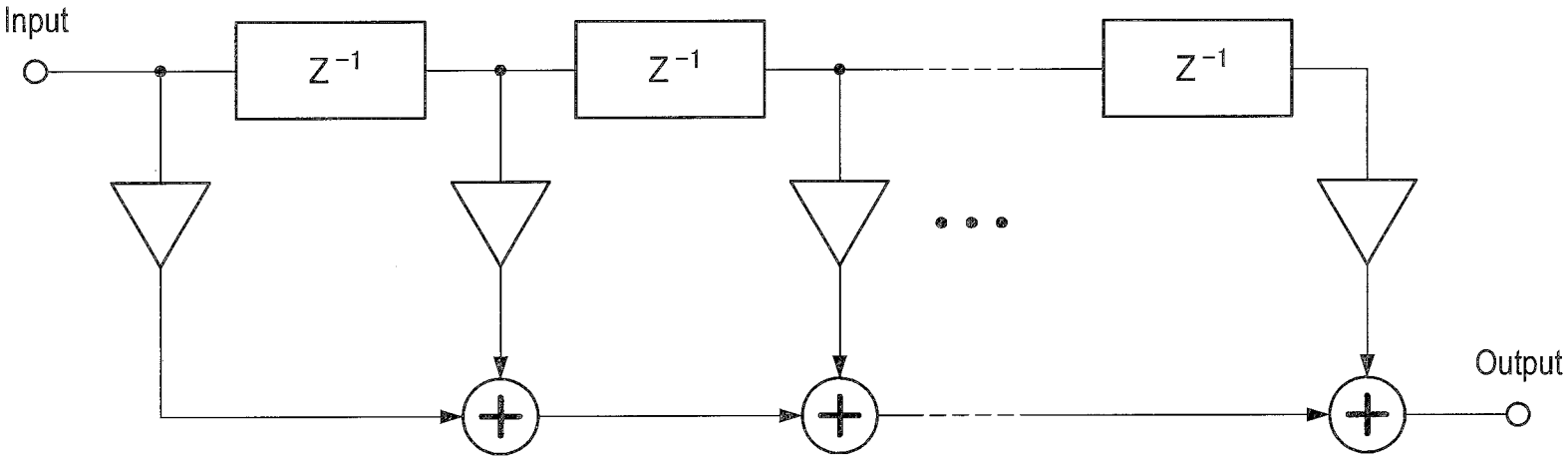
FIG. 4 is a diagram for describing an exemplary configuration of a digital filter that is used to perform a filtering process of providing inverse characteristics of characteristics of a speaker.

The inverse filter processing unit 112 converts the characteristics of an audio signal using a filter, which is set based on inverse characteristics of a speaker calculated previously. More specifically, a digital filter, which measures previously impulse response of a speaker to obtain its inverse characteristics and performs filter processing to provide acoustic characteristics corresponding to the inverse characteristics, is configured. The digital filter that provides acoustic characteristics corresponding to inverse characteristics is configured, for example, as illustrated in FIG. 4. As a digital filter that is used to provide acoustic characteristics over a relatively wide range of frequencies such as inverse characteristics of a speaker, for example, a finite impulse response (FIR) filter can be employed. The inverse filter processing unit 112 processes an audio signal and provides acoustic characteristics corresponding to inverse characteristics for an input signal by using the digital filter as described above.

Figure 5:
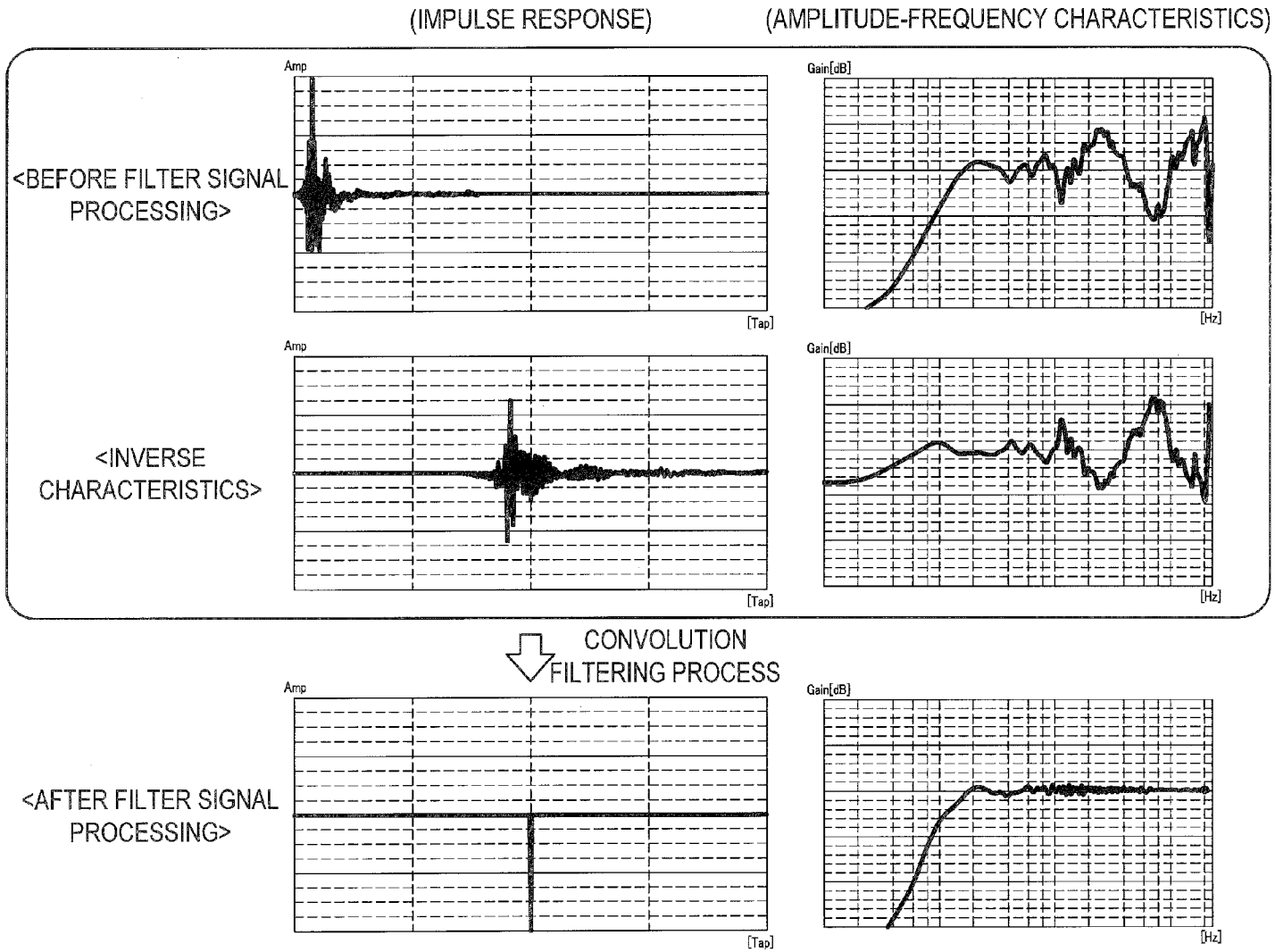
FIG. 5 is a diagram for describing an audio signal correcting process by an inverse filter processing unit according to the first embodiment.

For example, a sound reproduction system including the audio signal processing device 100 illustrated in FIG. 3 is assumed to have impulse response as shown on the upper view of FIG. 5 and amplitude-frequency characteristics that are representation in its frequency region. If the inverse characteristics of acoustic characteristics shown on the upper view of FIG. 5 are calculated, the result is as shown in the middle view of FIG. 5. If characteristics of a speaker are measured at the same measurement point by allowing the impulse response shown in the middle view of FIG. 5 to be implemented by a digital filter in the inverse filter processing unit 112, it is possible to obtain impulse response characteristics that are close to an impulse and flat amplitude-frequency characteristics, as shown on the lower view of FIG. 5. This makes it possible to obtain the original sound with no degradation in sound quality that is not dependent on the speaker characteristics.

The speaker characteristic adding processing unit 114 performs a process of adding predetermined acoustic characteristics to the acoustic characteristics of an audio signal. In the present embodiment, the speaker characteristic adding processing unit 114 allows acoustic characteristics of an audio signal having the amplitude-frequency and phase characteristics corrected simultaneously by the inverse filter processing unit 112 to correspond to acoustic characteristics of the left and right door speakers 12 and 13. This makes it possible for a reproduced sound at the listening points P1 and P2 to be closer to the acoustic characteristics of the left and right door speakers 12 and 13.

Figure 6:
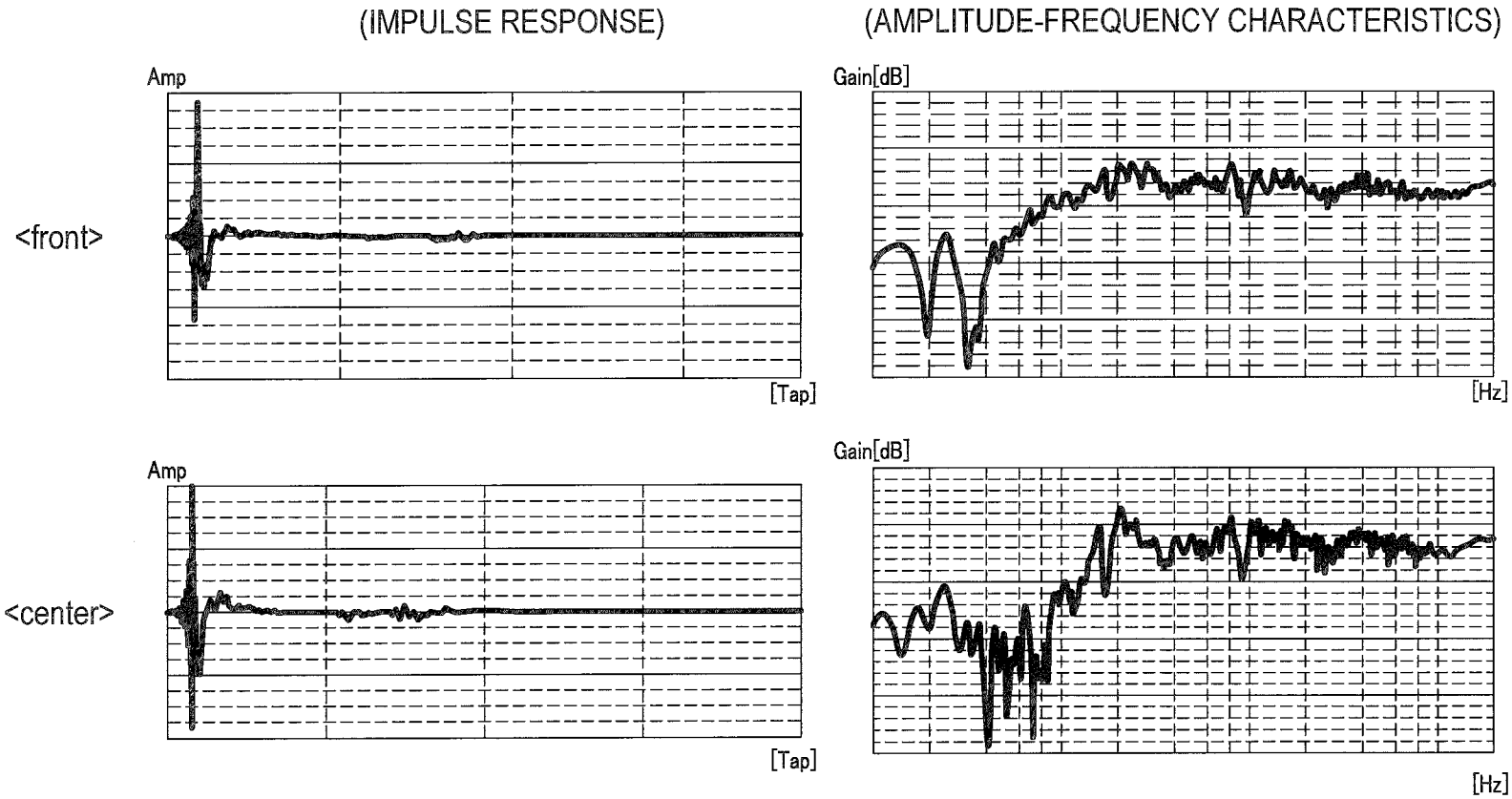
FIG. 6 is a diagram for describing a convolution process of an audio signal by a speaker characteristic adding processing unit according to the first embodiment.

The processing by the speaker characteristic adding processing unit 114 is described in detail with reference to FIG. 6. The upper view of FIG. 6 shows impulse response characteristics and amplitude-frequency characteristics of the left and right door speakers 12 and 13 (FRONT), and the lower view of FIG. 6 shows impulse response characteristics and amplitude-frequency characteristics of the center speaker 11 (CENTER) obtained after processing by the speaker characteristic adding processing unit 114. The acoustic characteristics of the left and right door speakers 12 and 13 (FRONT) are assumed to be obtained previously. The speaker characteristic adding processing unit 114 convolves the acoustic characteristics of the left and right door speakers 12 and 13 with the acoustic characteristics of the center speaker 11 that are corrected by the inverse filter processing unit 112, which in turn allows the acoustic characteristics of the center speaker 11 to be close to the acoustic characteristics of the left and right door speakers 12 and 13. The speaker characteristic adding processing unit 114 outputs the processed audio signal of the center speaker 11 to the D/A converter 115.

Furthermore, in the present embodiment, the filter signal processing unit 120 that performs processing of the reproduced sound that is output from the left door speaker 12 and the filter signal processing unit 130 that performs processing of the reproduced sound output from the right door speaker 13 may be configured without an inverse filter processing unit. Thus, the filter signal processing units 120 and 130 perform various types of signal processing without changing the characteristics of an input audio signal. The filter signal processing units 110, 120, and 130 output the audio signal that is subjected to signal processing to the respective D/A converts 115, 125, and 135.

The D/A converters 115, 125, and 135 convert the digital audio signal input from the respective filter signal processing units 110, 120, and 130 into an analog audio signal. The reproduced sounds converted into the analog audio signals by the D/A converters 115, 125, and 135 are output to the respective power amplifiers 117, 127, and 137.

The power amplifiers 117, 127, and 137 amplify the analog audio signals input from the respective D/A converters 115, 125, and 135 to drive the respective speakers.

Referring to FIG. 2, there is a difference between the distance from the left door speaker 12 to the listening point P1 on the driver's seat side and the distance from the center speaker 11 to the listening point P1. This difference in distance can be eliminated by adjusting the amount of delay in the filter signal processing unit 110 illustrated in FIGS. 3 and 4. Thus, it is possible to achieve a state where reproduced sounds from the speakers 11 and 12 arrive at the listening point P1 simultaneously. In addition, if a delay device that performs such a delay process is provided separately from the filter illustrated in FIGS. 3 and 4, that is, in the previous or subsequent stage of the filter illustrated in FIGS. 3 and 4, then it is possible to perform a process equivalent to that described above.

[1.3. Audio Signal Processing Method]

A reproduced sound to be output from the center speaker 11 is obtained by performing a process described below. First, the inverse filter processing unit 112 performs a process of obtaining impulse response characteristics close to an impulse and flat amplitude-frequency characteristics on an audio signal of the sum of sound sources LEFT and RIGHT to be input. This process is performed, for example, using a digital filter that is used to provide acoustic characteristics corresponding to the inverse characteristics illustrated in FIG. 4.

Subsequently, the speaker characteristic adding processing unit 114 performs a process (convolution filtering process) of convolving the acoustic characteristics of the left and right door speakers 12 and 13 obtained previously with those of the audio signal corrected by the inverse filter processing unit 112. This allows the acoustic characteristics of the center speaker 11 to be close to the acoustic characteristics of the left and right door speakers 12 and 13. The audio signal processed by the speaker characteristic adding processing unit 114 is output from the center speaker 11 via the D/A converter 115 and the power amplifier 117.

The sound source LEFT is output from the left door speaker 12 via the filter signal processing unit 120, the D/A converter 125, and the power amplifier 127. In addition, the sound source RIGHT is output from the right door speaker 13 via the filter signal processing unit 130, the D/A converter 135, and the power amplifier 137.

In this way, for a reproduced sound having a mid- and high-range, the characteristics of the center speaker 11 observed at the listening points P1 and P2 is corrected to be close to the characteristics of the left door speaker 12 and the right door speaker 13. As a result, in the reproduction frequency range of 300 Hz to 20 kHz, the characteristics of the center speaker 11 are allowed to match the characteristics of the door speakers 12 and 13, and thus it is possible to align the arrival time and reproduction level of the reproduced sound at the listening points P1 and P2. This makes it possible to achieve enhanced sound localization simultaneously at the driver's seat and the front passenger seat.

[1.4. Example (Correction of Acoustic Characteristics by Audio Signal Processing Device)]

Figure 7:
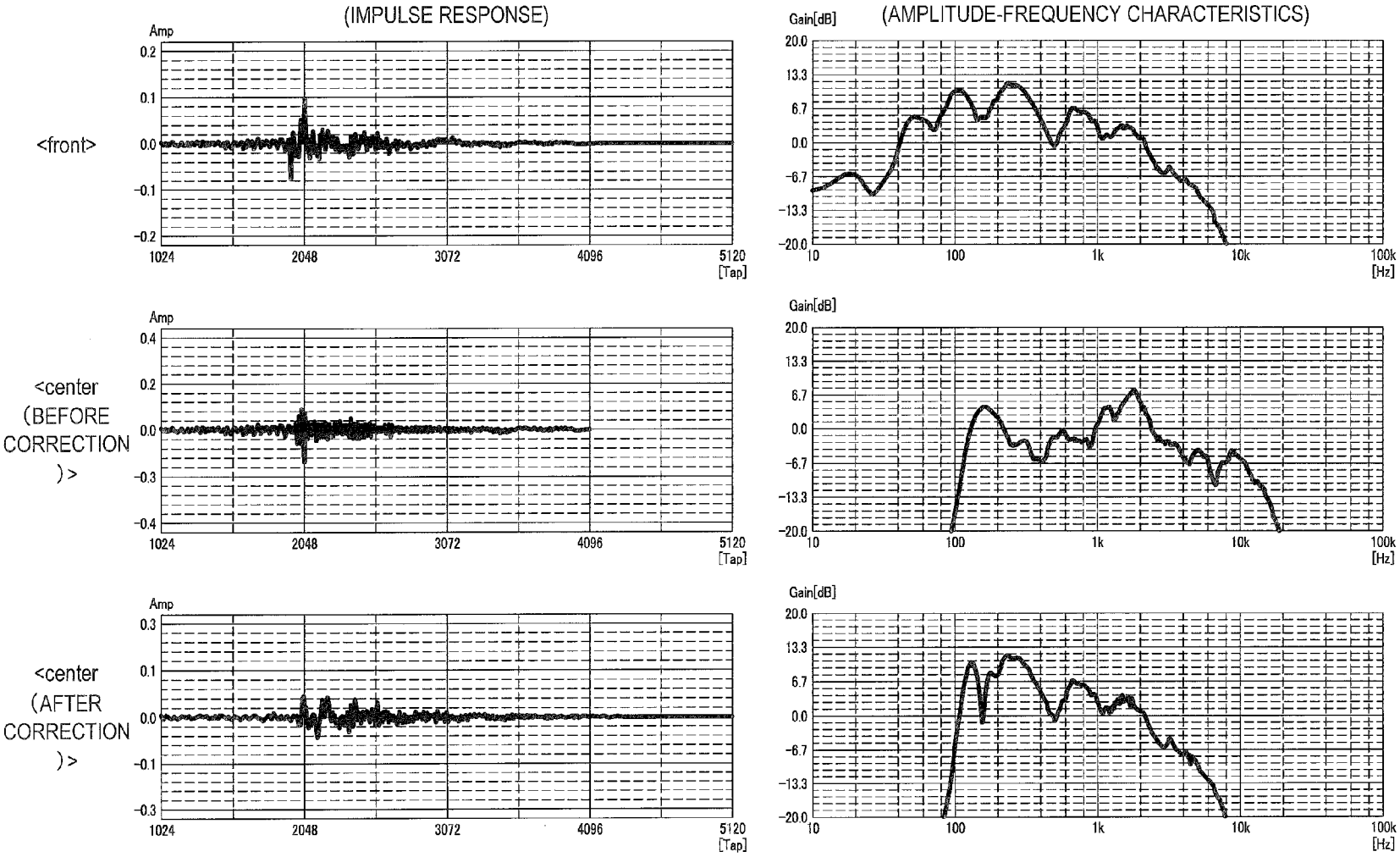
FIG. 7 is a graph showing the impulse response characteristics and amplitude-frequency characteristics before and after correction by an audio signal process according to the first embodiment.

Referring to FIG. 7, an example of results obtained by measuring acoustic characteristics at a listening point on the driver's seat side in case of using the audio signal processing device 100 according to the present embodiment is described. The upper view of FIG. 7 shows the impulse response characteristics and amplitude-frequency characteristics of the audio signal output from the left and right door speakers 12 and 13 (FRONT). The middle view of FIG. 7 shows the impulse response characteristics and amplitude-frequency characteristics of the audio signal output from the center speaker 11 (CENTER (BEFORE CORRECTION)). The lower view of FIG. 7 shows the impulse response characteristics and amplitude-frequency characteristics of the audio signal output from the center speaker 11 after correction of acoustic characteristics by the audio signal processing device 100 (CENTER (AFTER CORRECTION)).

As shown in FIG. 7, the impulse response characteristics and amplitude-frequency characteristics of the center speaker 11 have different waveforms between before and after the correction of acoustic characteristics. In particular, in a frequency range of 300 Hz or more, it can be ensured that the impulse response characteristics and amplitude-frequency characteristics of the center speaker 11 after the correction have a waveform that is close to that of the acoustic characteristics of the left and right door speakers 12 and 13. In other words, it can be seen that the audio signal processing device 100 allows the acoustic characteristics of the center speaker 11 to be close to the acoustic characteristics of the left and right door speakers 12 and 13.

2. Second Embodiment

A second embodiment of the present disclosure is now described with reference to FIGS. 8 and 9. In the present embodiment, the configuration of a sound reproduction system in an internal space of a vehicle is the same as that of the first embodiment, but the audio signal processing device is different in configuration between the first and second embodiments. The audio signal processing device according to the present embodiment achieves high quality sound and enhanced sound localization simultaneously at a plurality of listening points of a driver's seat and a front passenger seat. In the present embodiment, the configuration of a sound reproduction system in an internal space of a vehicle is the same as that illustrated in FIG. 2, so repeated description thereof will be omitted.

[2.1. Audio Signal Processing Device]

In order to provide high quality sound and enhanced sound localization simultaneously at the driver's seat and the front passenger seat, acoustic characteristics of a reproduced sound output from the respective speakers 11, 12, and 13 are corrected. Then, all the frequencies included in the reproduced sounds from the respective speakers 11, 12, and 13 are allowed to arrive at the listening points P1 and P2 in the vicinity of headrests of the driver's seat and the front passenger seat simultaneously at the same level.

For example, similarly to the first embodiment, the reproduction frequency range of the center speaker 11 is set to a reproduction frequency range of 300 Hz to 20 kHz, and the reproduction frequency range of the left and right door speakers 12 and 13 is set to a reproduction frequency range of 80 Hz to 20 kHz. In this case, in the reproduction frequency range of 300 Hz to 20 kHz, the reproduced sounds from the center speaker 11 and the door speaker 12 (or 13) on the side close to the listening point P1 (or P2) are allowed to arrive simultaneously at the same level. In the reproduction frequency range of 300 Hz or less, the reproduced sounds from the left and right door speakers 12 and 13 are allowed to arrive simultaneously at the same level.

Figure 8:
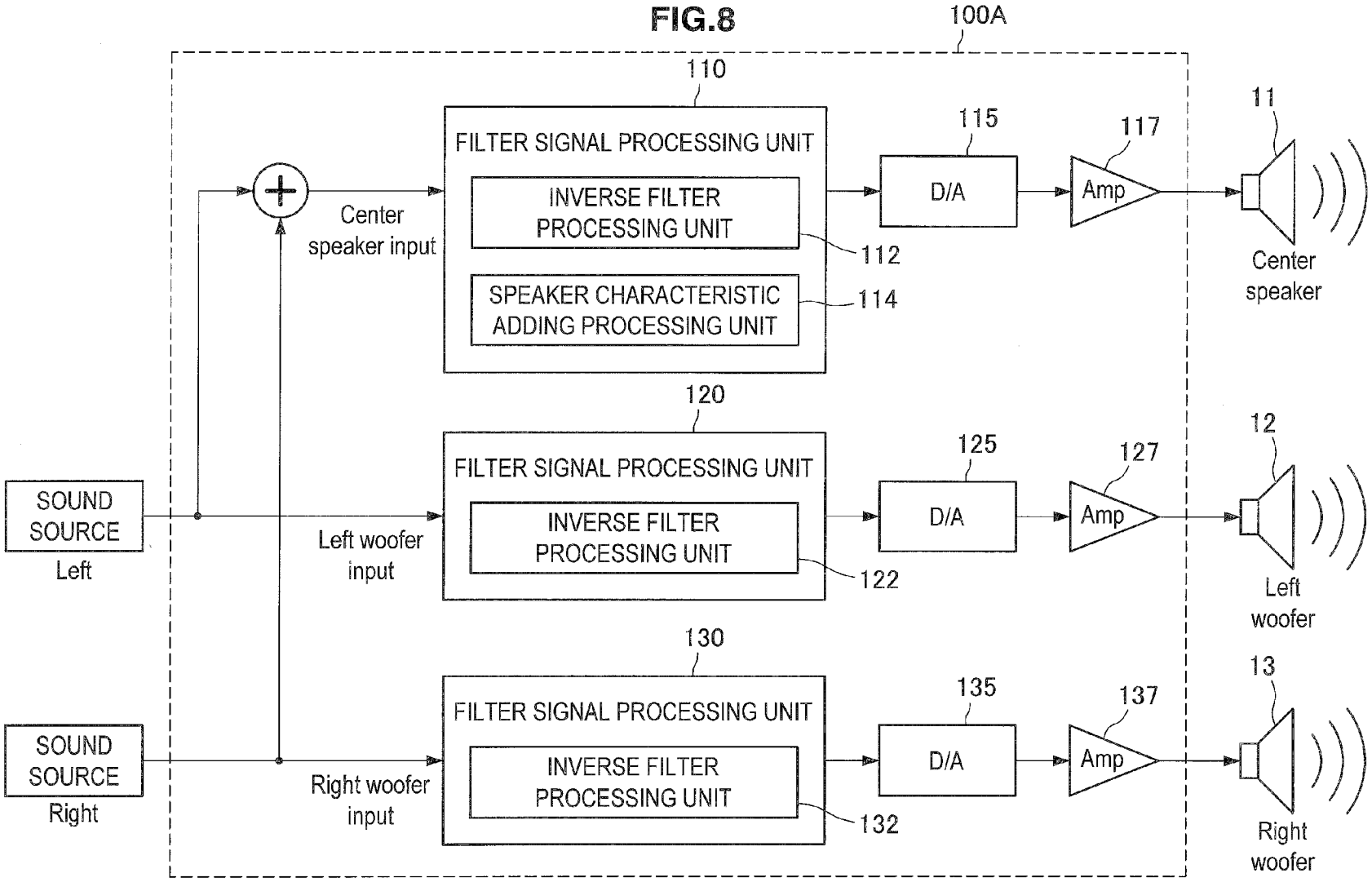
FIG. 8 is a block diagram illustrating the configuration of an audio signal processing device according to a second embodiment of the present disclosure.

More specifically, acoustic characteristics are corrected by an audio signal processing device 100A as illustrated in FIG. 8. The audio signal processing device 100A illustrated in FIG. 8 is different from the audio signal processing device 100 according to the first embodiment illustrated in FIG. 3 in that the filter signal processing units 120 and 130, which perform a process on an audio signal to be output from the respective left and right door speakers 12 and 13, include inverse filter processing units 122 and 132, respectively.

In other words, for the audio signals to be output from the respective speakers 11, 12, and 13, impulse response characteristics close to an impulse and flat amplitude-frequency characteristics are obtained based on inverse characteristics of audio signals obtained previously by the inverse filter processing units 112, 122, and 132. This makes it possible to achieve reproduction faithful to original sound and accurate sound localization by a natural reproduced sound in which variations in the output due to the pitch of sound are eliminated. In addition, the filter signal processing unit 110 for the center speaker 11 is configured to include a speaker characteristic adding processing unit 114 that is used to allow acoustic characteristics of the left and right speakers 12 and 13 to correspond to acoustic characteristics of the center speaker 11.

[2.2. Audio Signal Processing Method]

The reproduced sounds to be output from the respective speakers 11, 12, and 13 are obtained by performing a process described below. First, in low-range frequencies, the arrival time from the left and right door speakers 12 and 13 to the respective driver's seat and the front passenger seat is aligned. Thus, acoustic characteristics of the left and right door speakers 12 and 13 are corrected using the same parameter for the left and right ones. This is because if different parameters are set for the left and right speakers, the arrival time of sound is aligned for only one of the driver's seat and the front passenger seat but the arrival time of sound is not aligned for the other seat.

Subsequently, the audio signal of the center speaker 11 is corrected using the acoustic characteristics of the left and right door speakers 12 and 13 corrected as described above. In other words, the speaker characteristic adding processing unit 114 makes acoustic characteristics of the reproduced sound output from the center speaker 11 correspond to acoustic characteristics of the left and right door speakers 12 and 13. In this way, the correction of acoustic characteristics for the respective speakers 11, 12, and 13 is performed. In the reproduction frequency range of 300 Hz to 20 kHz, the reproduced sounds from the center speaker 11 and the door speaker 12 (or 13) on the side close to the listening point P1 (or P2) are allowed to arrive at the driver's seat and the front passenger seat simultaneously at the same level. In the reproduction frequency range of 300 Hz or less, the reproduced sounds from the left and right door speakers 12 and 13 are allowed to arrive at the driver's seat and the front passenger seat simultaneously at the same level. Thus, it is possible to achieve high quality sound and enhanced sound localization simultaneously at both seats.

If the correction of audio signals is not performed by the audio signal processing device according to the present embodiment or the first embodiment describe above, then, for example, at the driver's seat, characteristics of the left door speaker 12 do not match those of the center speaker 11. Thus, deviation or discrepancy occurs in the sound localization of the reproduced sound of a musical instrument included in only the sound source LEFT or the vocal and low frequency components included equally in the sound sources LEFT and RIGHT. On the other hand, the correction of audio signals by the audio signal processing device according to the present embodiment or the above-described first embodiment allows the characteristics of the respective speakers 11, 12, and 13 to be matched with each other, thereby achieving enhanced sound localization.

Moreover, it is also true in case where an audio signal input to the audio signal processing device is a monaural signal. In other words, if an audio signal is not corrected by the audio signal processing device according to the present embodiment or the above-described first embodiment, then, for example, at the driver's seat, characteristics of the left door speaker 12 do not match those of the center speaker 11. Thus, deviation or discrepancy occurs in the sound localization of a monaural signal. On the other hand, the correction of audio signals by the audio signal processing device according to the present embodiment or the above-described first embodiment allows the characteristics of the respective speakers 11, 12, and 13 to be matched with each other, thereby achieving enhanced sound localization.

When acoustic characteristics are corrected for the left and right door speakers 12 and 13, the inverse filter processing units 122 and 132 perform a process of obtaining impulse response characteristics close to an impulse and flat amplitude-frequency characteristics as described above. In the present embodiment, then acoustic characteristics of the corrected audio signal may be further corrected so that the audio signal has a target characteristic that is to be a reference. In other words, each of the filter signal processing units 120 and 130 of the respective left and right door speakers 12 and 13 may be configured to include the speaker characteristic adding processing unit 114 of the filter signal processing unit 110 illustrated in FIG. 3. Although the speaker characteristic adding processing unit 114 according to the first embodiment performs a process of making acoustic characteristics of the center speaker 11 correspond to those of the left and right door speakers 12 and 13, the filter signal processing units 120 and 130 may be used to further correct acoustic characteristics of the left and right door speakers 12 and 13 to be acoustic characteristics of another speaker.

In this case, audio signals to be output from the left and right door speakers 12 and 13 are subjected to the first process that allows impulse response characteristics close to an impulse and amplitude-frequency characteristics to be obtained by the respective inverse filter processing units 122 and 132. Then, the corrected audio signal obtained by the first process is subjected to the second process that allows the audio signal to be corrected so that it may be close to a target characteristic by the speaker characteristic adding processing unit 114. This makes it possible to achieve reproduction faithful to original sound and accurate sound localization by a natural reproduced sound in which variations in the output due to the pitch of sound are eliminated, and it is also possible to achieve desired acoustic characteristics of a speaker.

[2.3. Example (Correction of Acoustic Characteristics by Audio Signal Processing Device)]

Figure 9:
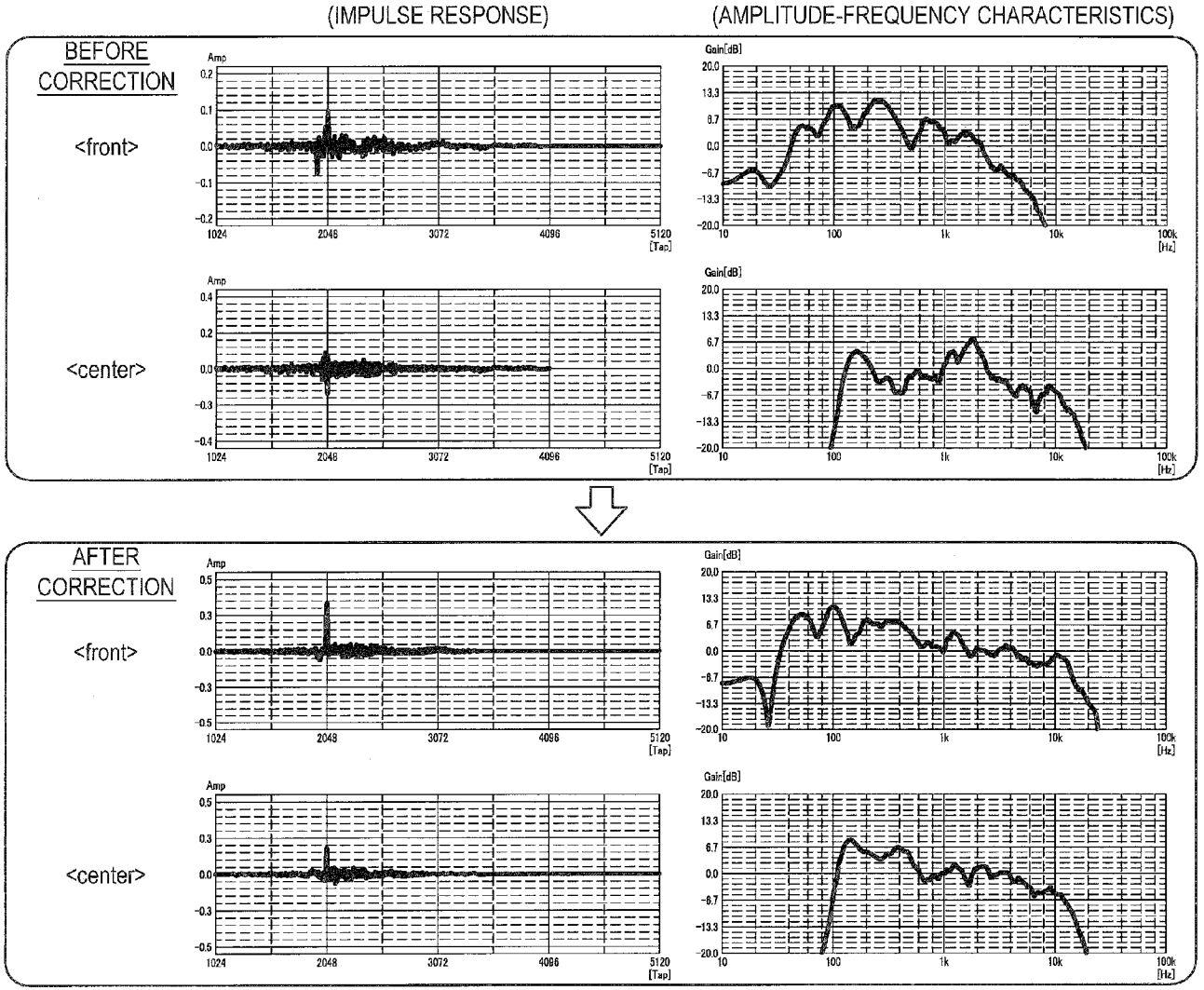
FIG. 9 is a graph showing the impulse response characteristics and amplitude-frequency characteristics before and after correction by an audio signal process according to the second embodiment.

Referring to FIG. 9, an example of results obtained by measuring acoustic characteristics at a listening point on the driver's seat side in a case of using the audio signal processing device 100A according to the present embodiment is described. The upper view of FIG. 9 shows the impulse response characteristics and amplitude-frequency characteristics of the audio signal output from the left and right door speakers 12 and 13 before the correction (FRONT) and shows the impulse response characteristics and amplitude-frequency characteristics of the audio signal output from the center speaker 11 before the correction (CENTER). The lower view of FIG. 7 shows the impulse response characteristics and amplitude-frequency characteristics of the audio signal output from the left and right door speakers 12 and 13 after the correction (FRONT) and shows the impulse response characteristics and amplitude-frequency characteristics of the audio signal output from the center speaker 11 after the correction (CENTER).

As shown in FIG. 9, the impulse response characteristics and amplitude-frequency characteristics of the center speaker 11 have waveforms that are different between before and after the correction. In terms of impulse response, all of the speakers 11, 12, and 13 appear to have characteristics that are more close to an impulse, and the center speaker 11 has a waveform close to that of the left and right door speakers 12 and 13. In addition, in terms of amplitude-frequency characteristics, especially, in the frequency range of 300 Hz or more, it can be ensured that waveforms of the center speaker 11 and the left and right door speakers 12 and 13 after the correction are close to each other, and their acoustic characteristics are matched with each other. In other words, it can be seen that the audio signal processing device 100A allows the acoustic characteristics of the center speaker 11 to be close to the acoustic characteristics of the left and right door speakers 12 and 13.

3. Third Embodiment

A third embodiment of the present disclosure is now described with reference to FIGS. 10 to 13. The configuration of a sound reproduction system in an interior space of a vehicle according to the third embodiment is different from that of the first embodiment in that it is configured to further include left and right door tweeters in addition to three speakers of the first embodiment. An audio signal process of achieving high quality sound and enhanced sound localization simultaneously at a plurality of listening points of the driver's seat and the front passenger seat in such an interior space of a vehicle is described below.

[3.1. Arrangement of Speaker]

Figure 10:
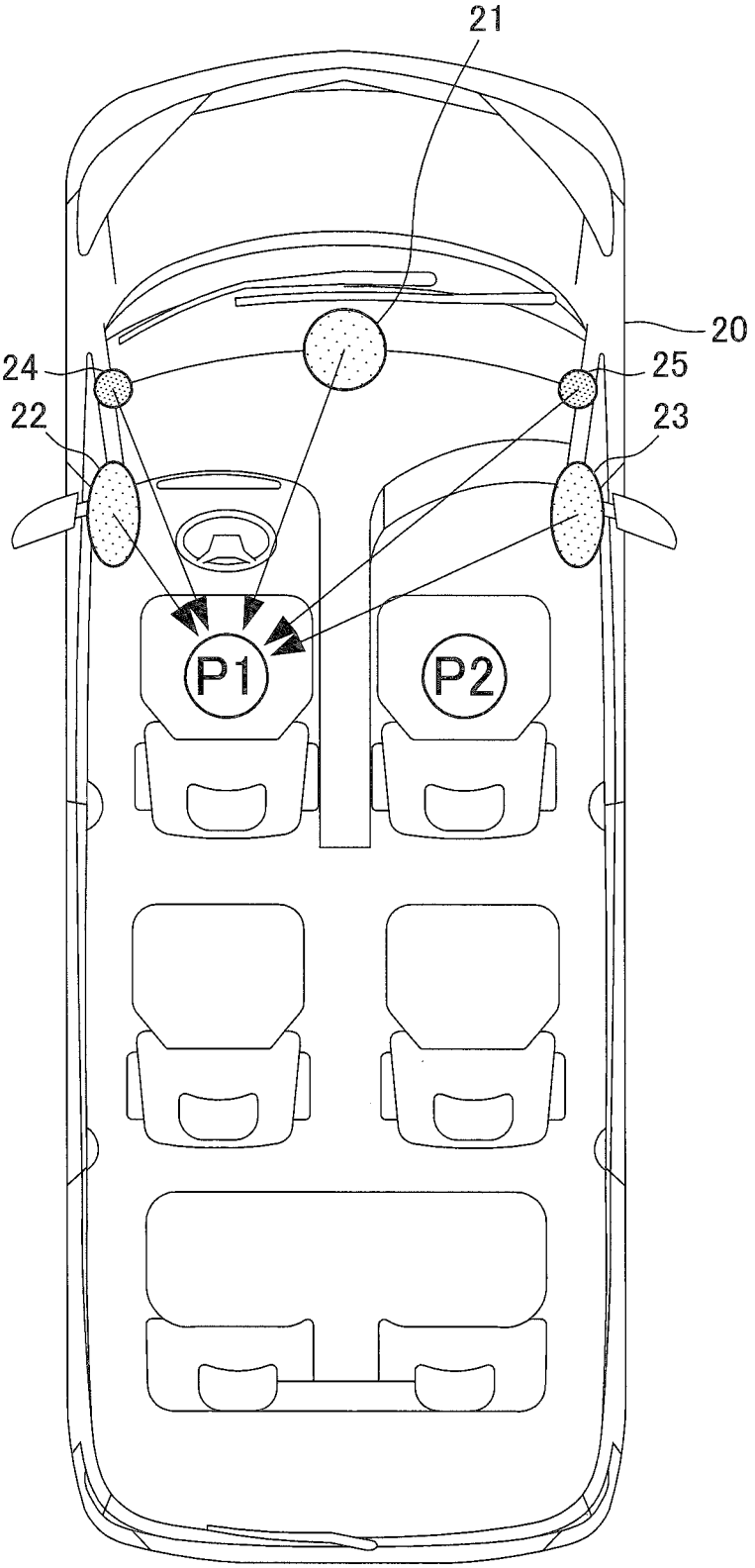
FIG. 10 is a diagram for describing an exemplary arrangement of a speaker in an in-vehicle space according to a third embodiment of the present disclosure.

Referring to FIG. 10, an exemplary arrangement of speakers in an interior space of a vehicle according to the present embodiment is described. FIG. 10 is a diagram for describing an exemplary arrangement of speakers in an interior space of a vehicle according to the present embodiment.

In the interior space of a vehicle 20 illustrated in FIG. 10, there are a center speaker 21 provided on a dashboard, a left door woofer 22 provided in the door on the driver's seat side, and a right door woofer 23 provided in the door on the front passenger seat side. Furthermore, in the vehicle 20 according to the present embodiment, there are a left door tweeter 24 provided in the door on the driver's seat side and a right door tweeter 25 provided in the door on the front passenger seat side.

The center speaker 21 is arranged substantially at the center in the width direction of the vehicle 20 between the left door woofer and tweeter 22 and 24 and the right door woofer and tweeter 23 and 25. The center speaker 21 has a reproduction frequency range of a mid- and high-range, for example, of 300 Hz to 20 kHz. The left door woofer 22 and the right door woofer 23 have a reproduction frequency range of a mid- and low-range, for example, of 80 Hz to 3 kHz. The left door tweeter 24 and the right door tweeter 25 have a reproduction frequency range of a high-range, for example, of 3 kHz to 20 kHz. In the present embodiment, the left and right door woofers 22 and 23 have the same amplitude-frequency characteristics and phase characteristics, and the left and right door tweeters 24 and 25 have the same amplitude-frequency characteristics and phase characteristics.

In the present embodiment, in order to obtain enhanced sound localization simultaneously at the respective listening points P1 and P2 as the respective listening points P1 and P2 in the vicinity of headrests of the driver's seat and the front passenger seat, the reproduced sounds obtained through an audio signal process by an audio signal processing device 200 are output from the respective speakers 21 to 25. The audio signal processing device 200 performs a signal process that allows all the frequencies included in the reproduced sounds from the respective speakers to arrive at the listening points P1 and P2 simultaneously at the same level.

It is considered that the reproduced sounds that are heard at the listening points P1 and P2 have the following configuration. First, in a reproduction frequency range of 300 Hz to 20 kHz, the three reproduced sounds which come from the center speaker 21, and the door woofer 22 (or 23) and door tweeter 24 (or 25) on the side close to the listening point P1 (or P2) are predominant. For example, when a reproduced sound is heard at the driver's seat, the reproduced sounds that are output from the center speaker 21, the left door woofer 22, and the left door tweeter 24 are predominant. When a reproduced sound is heard at the front passenger seat, the reproduced sounds that are output from the center speaker 21, the right door woofer 23, and the right door tweeter 25 are predominant. Furthermore, when a reproduced sound has a frequency range of 300 Hz or less, the reproduced sound is outside the reproduction range of the center speaker 21 and the door tweeters 24 and 25, and thus the reproduced sounds from the left door woofer 22 and the right door woofer 23 are heard at the respective listening points P1 and P2.

In order to obtain enhanced sound localization simultaneously at the driver's seat and the front passenger seat, it is necessary for the respective frequencies included in the reproduced sounds from the speakers 21 to 25 to arrive at the listening points P1 and P2 in the vicinity of headrests of the driver's seat and the front passenger seat simultaneously at the same level. In other words, in a reproduction frequency range of 300 Hz to 20 kHz, the respective reproduced sounds from the center speaker 21 and the door woofer 22 (or 23) and door tweeter 24 (or 25) on the side close to the listening point P1 (or P2) are allowed to arrive at the listening point P1 (or P2) simultaneously at the same level. In addition, when a reproduced sound has a frequency range of 300 Hz or less, the reproduced sounds from the left door woofer 22 or the right door woofer 23 are allowed to arrive at the listening point P1 (or P2) simultaneously at the same level.

Thus, in the audio signal processing device 200 according to the present embodiment, when a reproduced sound has a mid- and high-range, the characteristics of the center speaker 21 observed at the listening points P1 and P2 are corrected to be close to the characteristics of the door woofers 22 and 23 and the door tweeters 24 and 25. As a result, the characteristics of the center speaker 21 are allowed to match the characteristics of the door woofers 22 and 23 and the door tweeters 24 and 25 in the reproduction frequency range of 300 Hz to 20 kHz, and thus it is possible to align the arrival time and reproduction level of the reproduced sound at the listening points P1 and P2.

[3.2. Audio Signal Processing Device]

Figure 11:
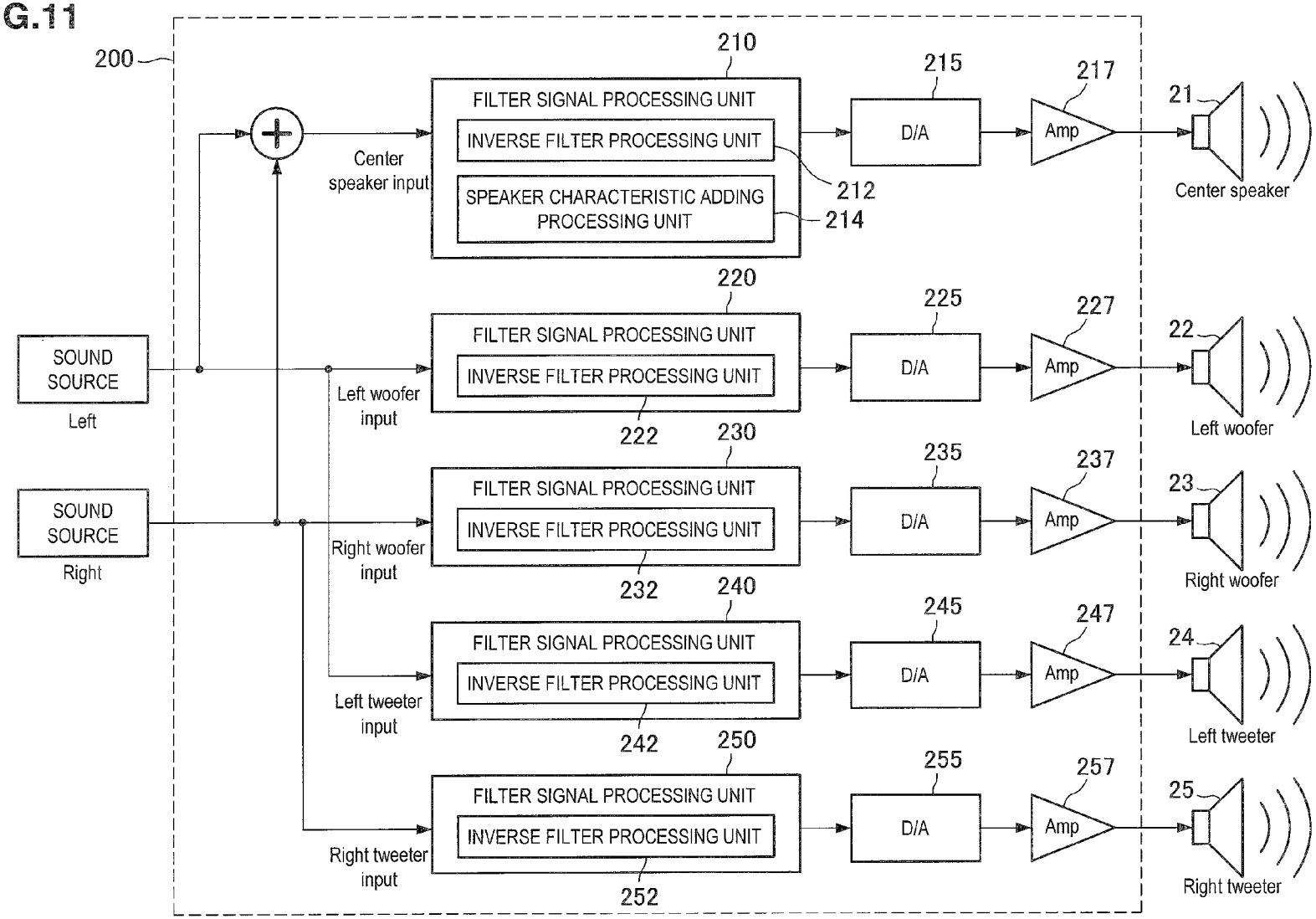
FIG. 11 is a block diagram illustrating the configuration of an audio signal processing device according to the third embodiment.

FIG. 11 illustrates the configuration of the audio signal processing device 200 according to the present embodiment. The present embodiment illustrates a case where stereo (or stereophonic) reproduction that reproduces two-channel sound is performed. In addition, in the present embodiment, although the description is based on a case where an input signal is a digital signal, the description can be similarly applied to an analog audio signal by performing an A/D conversion process before filter signal processing units 210 to 250 perform their processes.

The audio signal processing device 200 is configured to include filter signal processing units 210 to 250, D/A converts 215 to 255, and power amplifiers 217 to 257, for the respective speakers 21 to 25, as illustrated in FIG. 11. The functional components perform a process similar to that of the first embodiment illustrated in FIG. 3. Thus, the detailed description thereof will be omitted.

As illustrated in FIG. 11, the left door woofer 22 and the left door tweeter 24 are input with a sound source LEFT that is recorded in stereo, and the right door woofer 23 and the right door tweeter 25 are input with a sound source RIGHT that is recorded in stereo. In addition, the center speaker 21 is input with a component of the sound sources LEFT and RIGHT.

[3.3. Audio Signal Processing Method]

The reproduced sounds output from the respective speakers 21 to 25 are obtained by performing a process described below. First, similarly to the second embodiment, in low-range frequencies, the arrival time from the left and right door woofers 22 and 23 to the respective driver's seat and the front passenger seat is aligned. Thus, acoustic characteristics of the left and right door woofers 22 and 23 are corrected using the same parameter for the left and right ones. This is because if different parameters are set, the arrival time of sound is aligned for only one of the driver's seat and the front passenger seat, but the arrival time of sound is not aligned for the other one. In this process, the original acoustic characteristics of a speaker are measured previously and the measured characteristics are subjected to an inverse function process, and thus only flattening of the amplitude characteristics is performed, resulting in the achievement of a natural reproduced sound.

Subsequently, in high-range frequencies, the arrival time from the left and right door tweeters 24 and 25 to the respective driver's seat and the front passenger seat is aligned. Thus, acoustic characteristics of the left and right door tweeters 24 and 25 are corrected using the same parameter for the left and right ones. The correction of acoustic characteristics of the door tweeters 24 and 25 can be performed similarly to the case of the door woofers 22 and 23.

Furthermore, the audio signal processing device 200 corrects characteristics obtained by combining acoustic characteristics of the corrected door woofers 22 and 23 with acoustic characteristics of the door tweeters 24 and 25. For example, in the interior space of a vehicle provided with five speakers of the center speaker 21, the left and right door woofers 22 and 23, and the left and right door tweeters 24 and 25 as illustrated in FIG. 10, the entire frequency range is covered by the door woofers 22 and 23 and the door tweeters 24 and 25. Thus, the combined characteristics of the left door woofer 22 and the left door tweeter 24 and the combined characteristics of the right door woofer 23 and the right door tweeter 25 are corrected to have a target characteristic that is to be a reference to cover the entire frequency range.

The combined characteristics of the door woofers 22 and 23 with the door tweeters 24 and 25, which are generated in this way, are subjected to flattening of their amplitude-frequency characteristics, resulting in the achievement of a natural reproduced sound. Alternatively, the combined characteristics may be corrected to be close to amplitude-frequency characteristics of a target characteristic. Then, the characteristics of the respective speakers 22 to 25 obtained after the correction of their amplitude-frequency characteristics are subjected to an inverse function process, and thus the impulse response characteristics are close to an impulse. Thus, the audio signal of high quality sound in which the door woofers 22 and 23 and the door tweeters 24 and 25 cover the entire frequency range is obtained.

Then, the audio signal of the center speaker 21 is corrected using the corrected acoustic characteristics. Such a process can be performed similarly to that of the second embodiment. In other words, the speaker characteristic adding processing unit 214 makes acoustic characteristics of the generated sound that is output from the center speaker 21 correspond to acoustic characteristics of the left and right door woofers 22 and 23 and the door tweeters 24 and 25. In this way, acoustic characteristics of the respective speakers 21 to 25 are corrected.

The audio signal process according to the present embodiment can implement the state in which, in the reproduction frequency range of 300 Hz to 20 kHz, the reproduced sounds from the center speaker 21 and the door woofers 22 and 23 and door tweeters 24 and 25 on the side close to the listening point P1 (or P2) are allowed to arrive at the driver's seat and the front passenger seat simultaneously at the same level, and in the reproduction frequency range of 300 Hz or less, the reproduced sounds from the left and right door woofers 22 and 23 are allowed to arrive at the driver's seat and the front passenger seat simultaneously at the same level. Thus, it is possible to achieve high quality sound and enhanced sound localization simultaneously at both seats.

If the correction of an audio signal is not performed by the audio signal processing device 200 according to the present embodiment, then, for example, at the driver's seat, the combined characteristics of the left door woofer 22 and the left door tweeter 24 do not match the characteristics of the center speaker 21. Thus, deviation or discrepancy occurs in the sound localization of the reproduced sound of a musical instrument included in only the sound source LEFT or the vocal and low frequency components included equally in the sound sources LEFT and RIGHT. On the other hand, the correction of an audio signal by the audio signal processing device 200 according to the present embodiment allows the characteristics of the respective speakers 21 to 25 to be matched with each other, resulting in achieving enhanced sound localization.

Moreover, it is also true in case where an audio signal input to the audio signal processing device is a monaural signal. In other words, if an audio signal is not corrected by the audio signal processing device 200 according to the present embodiment, then, for example, at the driver's seat, the combined characteristics of the left door woofer 22 and the left door tweeter 24 do not match those of the center speaker 21. Thus, deviation or discrepancy occurs in the sound localization of a monaural signal. On the other hand, the correction of an audio signal by the audio signal processing device according to the present embodiment allows the characteristics of the respective speakers 21 to 25 to be matched with each other, resulting in achieving enhanced sound localization.

When acoustic characteristics of the left and right door woofers 22 and 23 or the left and right door tweeters 24 and 25 are corrected, inverse filter processing units 222, 232, 224, and 225 perform a process of obtaining impulse response characteristics close to an impulse and flat amplitude-frequency characteristics as described above. In the present embodiment, then acoustic characteristics of the corrected audio signal may be further corrected so that the audio signal has a target characteristic that is to be a reference. In other words, each of the filter signal processing units 220 and 250 of the respective speakers 22 to 25 may be configured to include the speaker characteristic adding processing unit 214 of the filter signal processing unit 210.

In this case, first, the audio signal to be output from the left and right door woofers 22 and 23 are subjected to the first process that allows impulse response characteristics close to an impulse and amplitude-frequency characteristics to be obtained by the respective inverse filter processing units 222 and 232. Then, the corrected audio signal obtained by the first process is subjected to the second process that allows the audio signal to be corrected to be close to a target characteristic by the speaker characteristic adding processing unit 214. This makes it possible to achieve reproduction faithful to original sound and accurate sound localization by a natural reproduced sound in which variations in the output due to the pitch of sound are eliminated, and it is also possible to achieve desired acoustic characteristics of a speaker. The door tweeters 24 and 25 may be also performed similarly as described above.

[3.4. Example (Correction of Acoustic Characteristics by Audio Signal Processing Device)]

Figure 12:
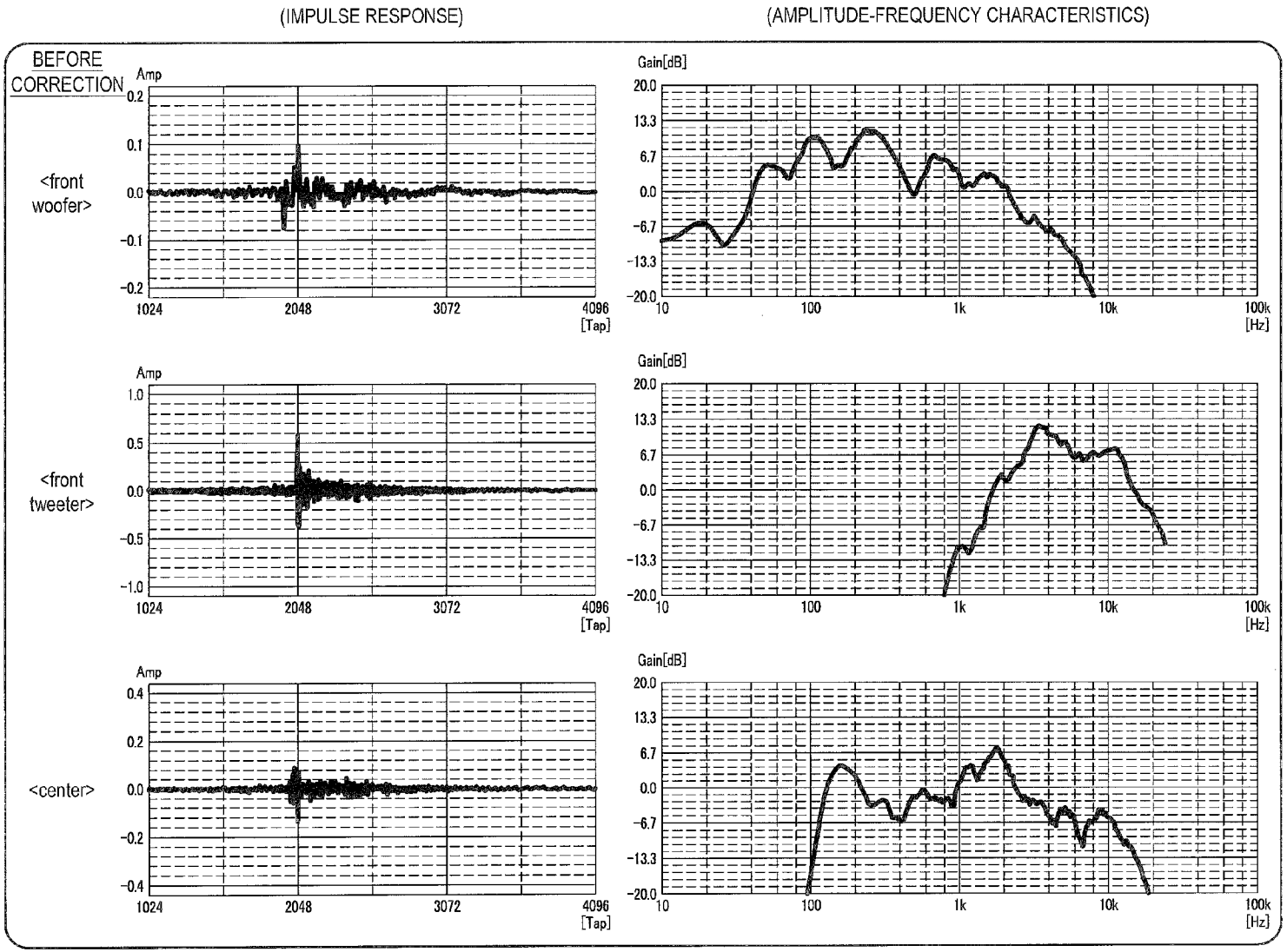
FIG. 12 is a graph showing the impulse response characteristics and amplitude-frequency characteristics before correction by an audio signal process according to the third embodiment.
Figure 13:
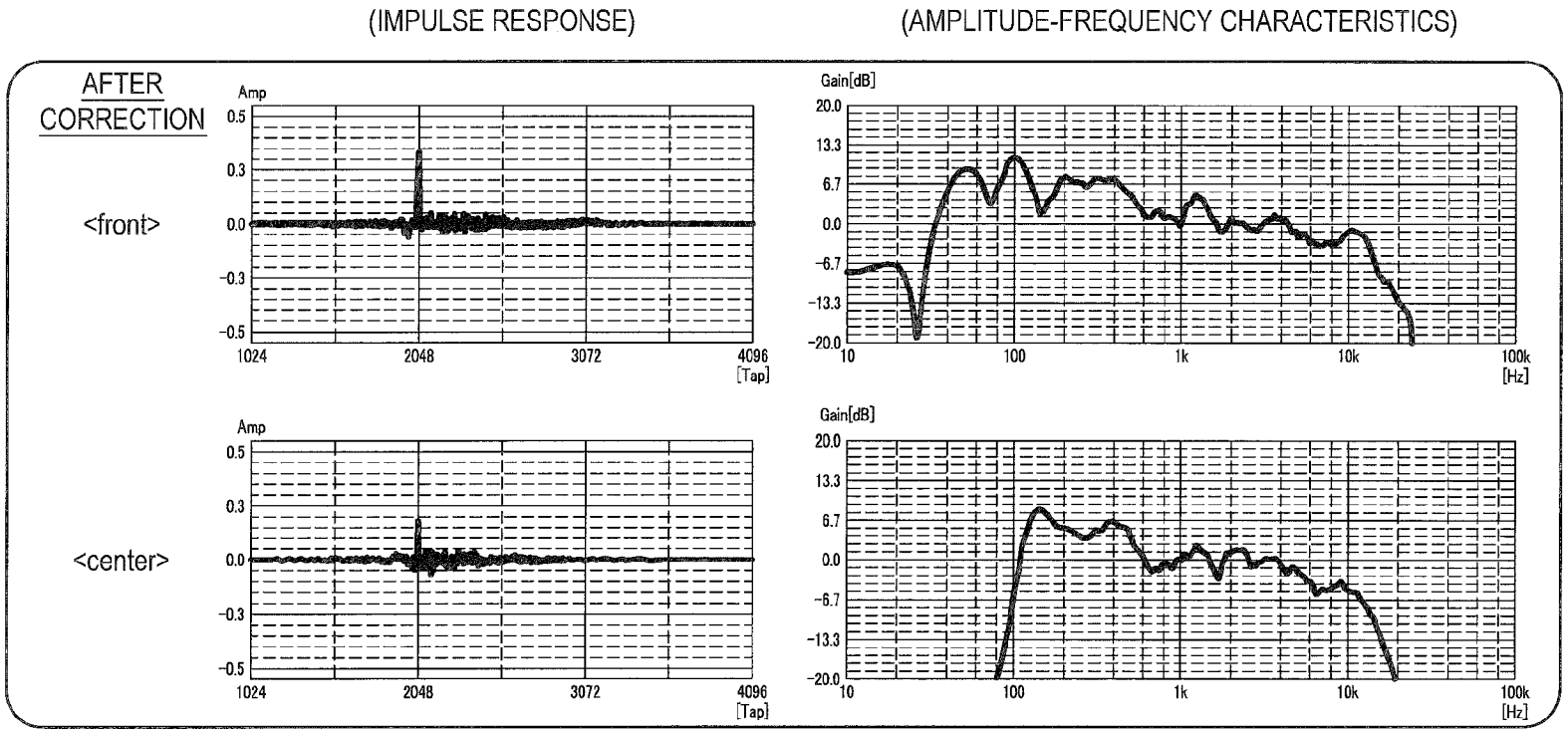
FIG. 13 is a graph showing the impulse response characteristics and amplitude-frequency characteristics after correction by an audio signal process according to the third embodiment.

Referring to FIGS. 12 and 13, an example of results obtained by measuring acoustic characteristics at a listening point on the driver's seat side in a case of employing the audio signal processing device 200 according to the present embodiment is described. FIG. 12 shows the impulse response characteristics and amplitude-frequency characteristics of the audio signal to be output from the left and right door woofers 22 and 23 before the correction (FRONT WOOFER), the impulse response characteristics and amplitude-frequency characteristics of the audio signal to be output from the left and right door tweeters 24 and 25 before the correction (FRONT TWEETER), and the impulse response characteristics and amplitude-frequency characteristics of the audio signal to be output from the center speaker 21 before the correction (CENTER). FIG. 13 shows the impulse response characteristics and amplitude-frequency characteristics of an audio signal obtained by combining the left and right door woofers 22 and 23 with the left and right door tweeters 24 and 25 after the correction (FRONT) and shows the impulse response characteristics and amplitude-frequency characteristics of the audio signal to be output from the center speaker 21 after the correction (CENTER).

As shown in FIGS. 12 and 13, the impulse response characteristics and amplitude-frequency characteristics of the combined audio signal of the left and right door woofers 22 and 23 and the left and right door tweeters 24 and 25 and the impulse response characteristics and amplitude-frequency characteristics of the audio signal to be output from the center speaker 21 have waveforms that are different between before and after the correction. In terms of impulse response, all of the combined audio signals of the left and right door woofers 22 and 23 and the left and right door tweeters 24 and 25 and the audio signal to be output from the center speaker 21 appear to have characteristics that are more close to an impulse. The audio signal of the center speaker 21 has a waveform that is close to the combined audio signal of the left and right door woofers 22 and 23 and the left and right door tweeters 24 and 25.

In terms of amplitude-frequency characteristics, in particular, in the frequency range of 300 Hz or more, a waveform of the audio signal of the center speaker 21 is close to that of the combined audio signal of the left and right door woofers 22 and 23 and the left and right door tweeters 24 and 25 after the correction. Thus, it can be seen that their acoustic characteristics are allowed to be matched with each other by the audio signal processing device 200, and the acoustic characteristics of the center speaker 21 are close to the acoustic characteristics of the combined audio signal of the left and right door woofers 22 and 23 and the left and right door tweeters 24 and 25.

4. Fourth Embodiment

A fourth embodiment of the present disclosure is described with reference to FIGS. 14 to 17. The configuration of a sound reproduction system in an interior space of a vehicle according to the fourth embodiment is different from that of the third embodiment in that it is configured to further include left and right door squawkers in addition to five speakers of the third embodiment. An audio signal process of obtaining high quality sound and enhanced sound localization simultaneously at a plurality of listening points of the driver's seat and the front passenger seat in such an interior space of a vehicle is described below.

[4.1. Arrangement of Speaker]

Figure 14:
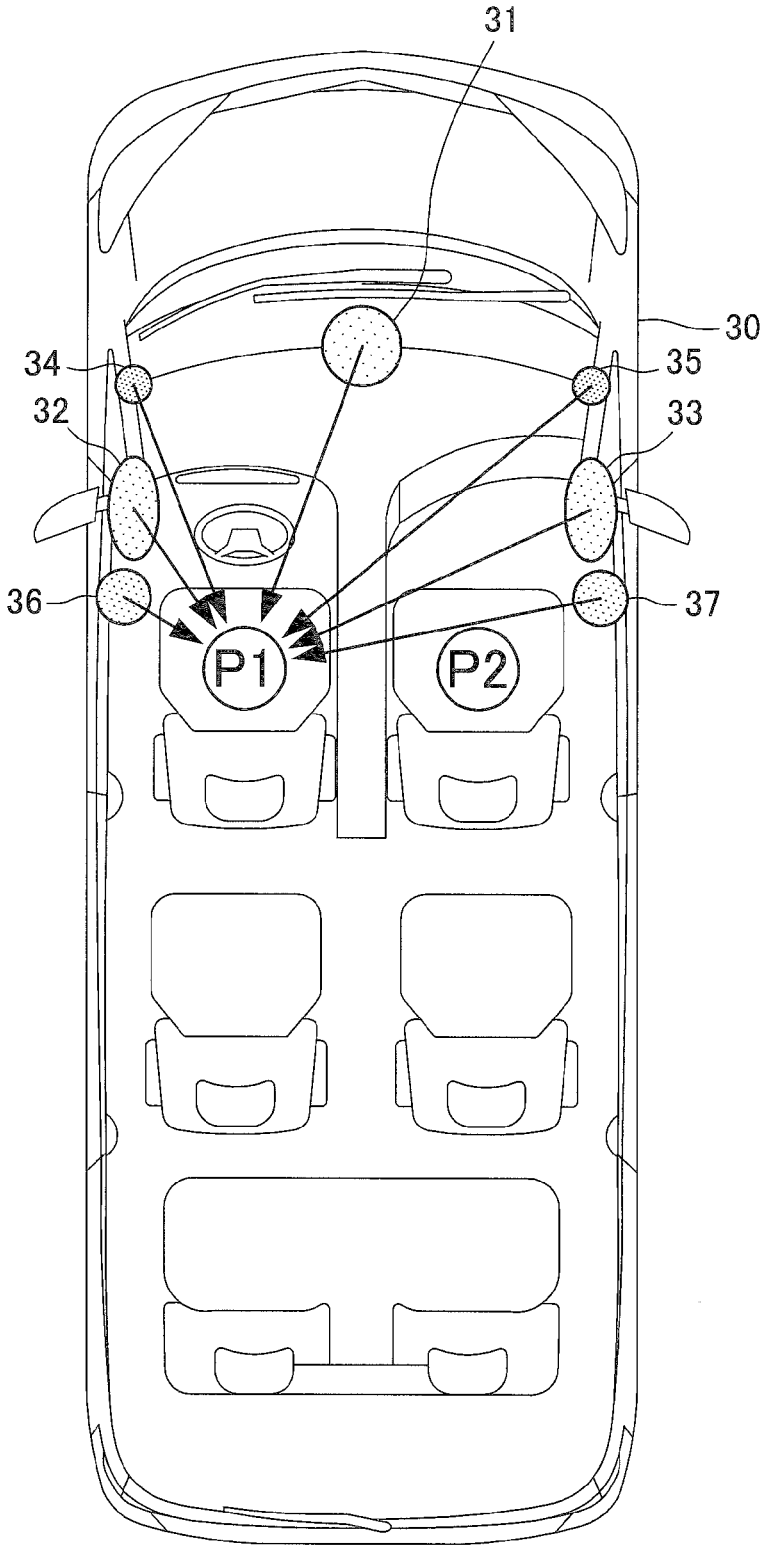
FIG. 14 is a diagram for describing an exemplary arrangement of a speaker in an in-vehicle space according to a fourth embodiment of the present disclosure.

Referring to FIG. 14, an exemplary arrangement of speakers in an interior space of a vehicle according to the present embodiment is described. FIG. 14 is a diagram for describing an exemplary arrangement of speakers in an interior space of a vehicle according to the present embodiment.

In the interior space of a vehicle 30 illustrated in FIG. 14, there are a center speaker 31 provided on a dashboard, a left door woofer 32 provided in the door on the driver's seat side, and a right door woofer 33 provided in the door on the front passenger seat side. Further, in the vehicle 30 according to the present embodiment, there are a left door tweeter 34 provided in the door on the driver's seat side, a right door tweeter 35 provided in the door on the front passenger seat side, a left door squawker 36 provided in the door on the driver's seat side, and a right door squawker 37 provided in the door on the front passenger seat side.

The center speaker 31 is arranged substantially at the center in the width direction of the vehicle 30 between the left door woofer, tweeter, and squawker 32, 34, and 36 and the right door woofer, tweeter, and squawker 33, 35, and 37. The center speaker 31 has a reproduction frequency range of a mid- and high-range, for example, of 300 Hz to 20 kHz. The left door woofer 32 and the right door woofer 33 have a reproduction frequency range of a low-range, for example, of 80 to 500 Hz. The left door tweeter 34 and the right door tweeter 35 have a reproduction frequency range of a high-range, for example, of 5 to 20 kHz. The left door squawker 36 and the right door squawker 37 have a reproduction frequency range of a mid-range, for example, of 500 Hz to 5 kHz. In the present embodiment, the left and right door woofers 32 and 33 have the same amplitude-frequency characteristics and phase characteristics, the left and right door tweeters 34 and 35 have the same amplitude-frequency characteristics and phase characteristics, and the left and right door squawkers 36 and 37 have the same amplitude-frequency characteristics and phase characteristics.

In the present embodiment, in order to obtain enhanced sound localization simultaneously at the respective listening points P1 and P2 as the respective listening points P1 and P2 in the vicinity of headrests of the driver's seat and the front passenger seat, the reproduced sounds obtained through an audio signal process by an audio signal processing device 300 are output from the respective speakers 31 to 37. The audio signal processing device 300 performs a signal process that allows the respective frequencies included in the reproduced sounds from the speakers to arrive at the listening points P1 and P2 simultaneously at the same level.

It is considered that the reproduced sounds that are heard at the listening points P1 and P2 have the following configuration. First, the four reproduced sounds, which come from the center speaker 21, the door woofer 32 or 33, the door tweeter 34 or 35, and the door squawker 36 or 37 in the vicinity of a listening point, are predominant in a reproduction frequency range of 300 Hz to 20 kHz. For example, when a reproduced sound is heard at the driver's seat, the reproduced sounds that are output from the center speaker 31, the left door woofer 32, the left door tweeter 34, and the left door squawker 36 are predominant. In addition, when a reproduced sound is heard at the front passenger seat, the reproduced sounds that are output from the center speaker 31, the right door woofer 33, the right door tweeter 35, and the right door squawker 37 are predominant. Furthermore, when a reproduced sound has a frequency range of 300 Hz or less, the reproduced sound is outside the reproduction range of the center speaker 31, the door tweeters 34 and 35, and the door squawkers 36 and 37, thus the reproduced sounds from the left door woofer 32 and the right door woofer 33 are heard at the respective listening points P1 and P2.

In order to obtain enhanced sound localization simultaneously at the driver's seat and the front passenger seat, it is necessary for the respective frequencies included in the reproduced sounds from the respective speakers 31 to 37 to arrive at the listening points P1 and P2 in the vicinity of headrests of the driver's seat and the front passenger seat simultaneously at the same level. In other words, in a reproduction frequency range of 300 Hz to 20 kHz, the reproduced sounds from the center speaker 21 and the door woofer 32 (or 33), door tweeter 34 (or 35), and door squawker 36 (or 37) which are in the vicinity of the listening point P1 (or P2) are allowed to arrive at the listening point P1 (or P2) simultaneously at the same level. In addition, when a reproduced sound has a frequency range of 300 Hz or less, the reproduced sounds from the left door woofer 32 and the right door woofer 33 are allowed to arrive at the respective listening points P1 and P2 simultaneously at the same level.

Thus, in the audio signal processing device 300 according to the present embodiment, for a reproduced sound of a mid- and high-range, the characteristics of the center speaker 31 observed at the listening points P1 and P2 are corrected to be close to the characteristics of the door woofers 32 and 33, the door tweeters 34 and 35, and the door squawkers 36 and 37. As a result, the characteristics of the center speaker 31 are allowed to match the characteristics of the door woofers 32 and 33, the door tweeters 34 and 35, and the door squawkers 36 and 37 in the reproduction frequency range of 300 Hz to 20 kHz, and thus it is possible to align the arrival time and reproduction level of the reproduced sound arriving at the listening points P1 and P2.

[4.2. Audio Signal Processing Device]

Figure 15:
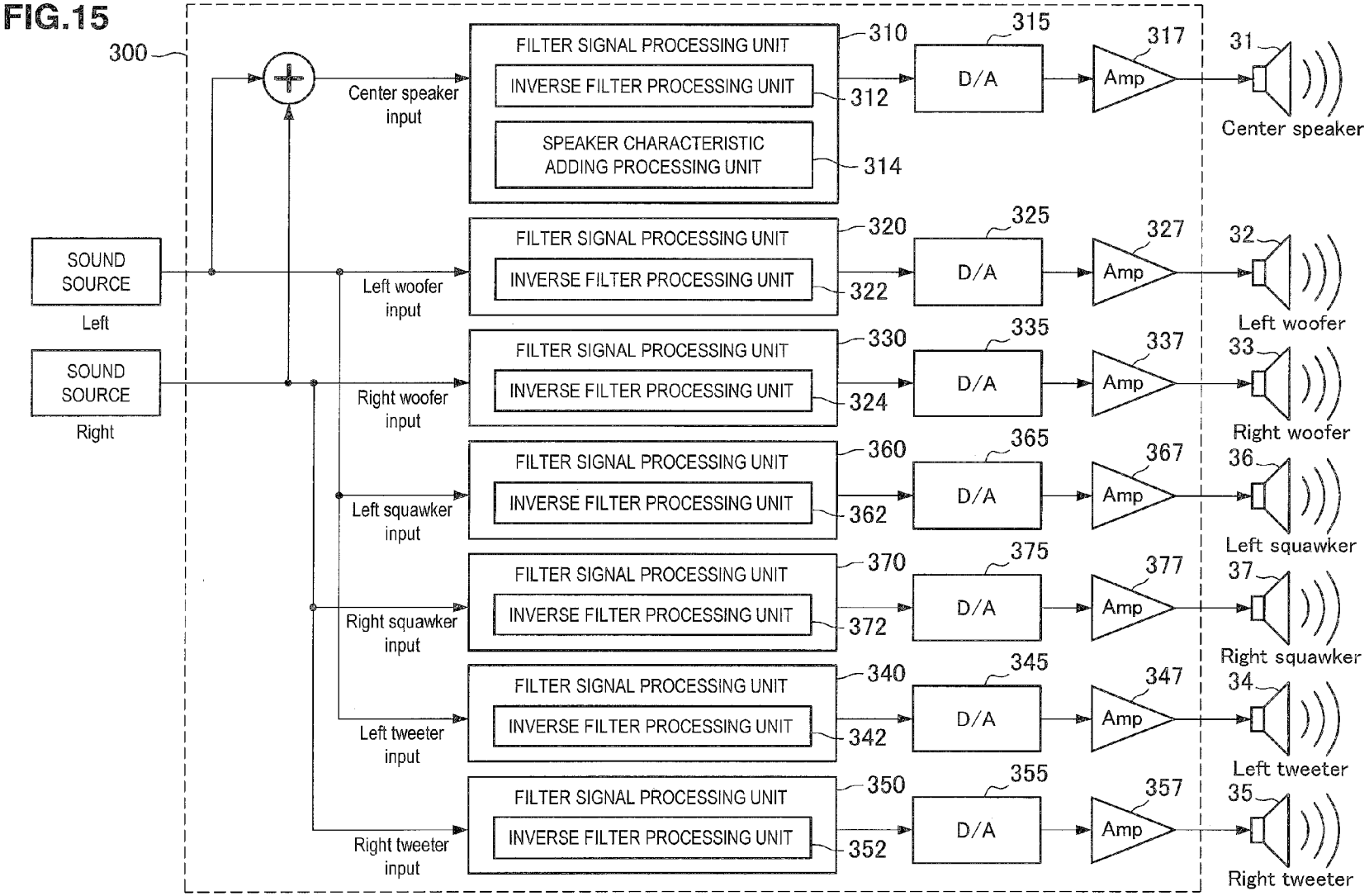
FIG. 15 is a block diagram illustrating the configuration of an audio signal processing device according to the fourth embodiment.

FIG. 15 illustrates the configuration of the audio signal processing device 300 according to the present embodiment. The present embodiment illustrates a case where stereo (or stereophonic) reproduction that reproduces two-channel sound is performed. In addition, in the present embodiment, although the description is based on a case where an input signal is a digital signal, the description can be similarly applied to an analog audio signal by performing an A/D conversion process before filter signal processing units 310 to 370 perform their processes.

The audio signal processing device 300 is configured to include filter signal processing units 310 to 370, D/A converts 315 to 375, and power amplifiers 317 to 377, for the respective speakers 31 to 37, as illustrated in FIG. 15. The functional components perform a similar process to that of the first embodiment illustrated in FIG. 3. Thus, the detailed description thereof will be omitted.

As illustrated in FIG. 15, the left door woofer 32, the left door tweeter 34, and the left door squawker 36 are input with a sound source LEFT that is recorded in stereo, and the right door woofer 33, the right door tweeter 35, and the right door squawker 37 are input with a sound source RIGHT that is recorded in stereo. In addition, the center speaker 31 is input with a component of the sound sources LEFT and RIGHT.

[4.3. Audio Signal Processing Method]

The reproduced sounds output from the respective speakers 31 to 37 are obtained by performing a process described below. First, similarly to the second embodiment, the arrival time from the left and right door woofers 32 and 33 to the respective driver's seat and the front passenger seat is aligned. Thus, acoustic characteristics of the left and right door woofers 32 and 33 are corrected using the same parameter for the left and right ones. In this process, the original acoustic characteristics of a speaker are measured previously and the measured characteristics are subjected to an inverse function process, and thus only flattening of the amplitude characteristics is performed, resulting in the achievement of natural reproduced sounds.

Subsequently, the arrival time from the left and right door squawkers 36 and 37 to the respective driver's seat and the front passenger seat is aligned. Thus, acoustic characteristics of the left and right door squawkers 36 and 37 are corrected using the same parameter for the left and right ones. The correction of acoustic characteristics of the left and right door squawkers 36 and 37 can be performed similarly to the case of the door woofers 32 and 33.

Moreover, the arrival time from the left and right door tweeters 34 and 35 to the respective driver's seat and the front passenger seat is aligned. Thus, acoustic characteristics of the left and right door tweeters 34 and 35 are corrected using the same parameter for the left and right ones. The correction of acoustic characteristics of the left and right door tweeters 34 and 35 can be performed similarly to the case of the door woofers 32 and 33.

Furthermore, the audio signal processing device 300 corrects the combined characteristics of the corrected acoustic characteristics of the door woofers 32 and 33 and the corrected acoustic characteristics of the door tweeters 34 and 35 and the door squawkers 36 and 37. For example, in the interior space of a vehicle provided with seven speakers of the center speaker 31, the left and right door woofers 32 and 33, the left and right door tweeters 34 and 35, and the left and right door squawkers 36 and 37 as illustrated in FIG. 14, the entire frequency range is covered by the door woofers 32 and 33, the tweeters 34 and 35, and the door squawkers 36 and 37. Thus, the combined characteristics of the left door woofer 32, the left door tweeter 34, and the left door squawker 36 and the combined characteristics of the right door woofer 33, the right door tweeter 35, and the right door squawker 37 are corrected to have a target characteristic of a reference to cover the entire frequency range.

The combined characteristics of the door woofers 32 and 33, the door tweeters 34 and 35, and the door squawkers 36 and 37, which are generated in this way, are subjected to flattening of the amplitude-frequency characteristics, resulting in the achievement of natural reproduced sounds. Alternatively, the combined characteristics may be corrected to be close to amplitude-frequency characteristics of a target characteristic. Then, the impulse response characteristics of the respective speakers 32 to 37 after the correction of amplitude-frequency characteristics are allowed to close to an impulse by an inverse function process. Thus, the audio signal of high quality sound in which the door woofers 32 and 33, the tweeters 34 and 35, and the door squawkers 36 and 37 cover the entire frequency range is obtained.

Then, the audio signal of the center speaker 31 is corrected using the corrected acoustic characteristics. Such a process can be performed similarly to that of the second embodiment. In other words, the speaker characteristic adding processing unit 314 makes acoustic characteristics of the generated sound that is output from the center speaker 31 correspond to acoustic characteristics of the left and right door woofers 32 and 33, door tweeters 34 and 35, and door squawkers 36 and 37. In this way, acoustic characteristics of the respective speakers 31 to 37 are corrected.

The audio signal process according to the present embodiment can implement the state in which, in the reproduction frequency range of 300 Hz to 20 kHz, the reproduced sounds from the center speaker 31 and the door woofers 32 (or 33), door tweeters 34 (or 35), and door squawkers 36 (or 37) on the side close to the listening point P1 (or P2) are allowed to arrive at the driver's seat and the front passenger seat simultaneously at the same level, and in the reproduction frequency range of 300 Hz or less, the reproduced sounds from the left and right door woofers 32 and 33 are allowed to arrive at the driver's seat and the front passenger seat simultaneously at the same level. Thus, it is possible to achieve high quality sound and enhanced sound localization simultaneously at both seats.

If the correction of an audio signal is not performed by the audio signal processing device 300 according to the present embodiment, then, for example, at the driver's seat, the combined characteristics of the left door woofer 32, the left door tweeter 34, and the left door squawker 36 do not match the characteristics of the center speaker 31. Thus, deviation or discrepancy occurs in the sound localization of the reproduced sound of a musical instrument included in only the sound source LEFT or the vocal and low frequency components included equally in the sound sources LEFT and RIGHT. On the other hand, the correction of audio signals by the audio signal processing device 300 according to the present embodiment allows the characteristics of the respective speakers 31 to 37 to be matched with each other, resulting in achieving enhanced sound localization.

Moreover, it is also true in case where an audio signal input to the audio signal processing device is a monaural signal. In other words, if an audio signal is not corrected by the audio signal processing device 300 according to the present embodiment, then, for example, at the driver's seat, the combined characteristics of the left door woofers 32, the left door tweeter 34, and the left door squawker 36 do not match those of the center speaker 31. Thus, deviation or discrepancy occurs in the sound localization of a monaural signal. On the other hand, the correction of audio signals by the audio signal processing device according to the present embodiment allows the characteristics of the respective speakers 31 to 37 to be matched with each other, resulting in achieving enhanced sound localization.

When acoustic characteristics of the left and right door woofers 32 and 33, door tweeters 34 and 35, or door squawkers 36 and 37 are corrected, inverse filter processing units 322 to 372 perform a process of obtaining impulse response characteristics close to an impulse and flat amplitude-frequency characteristics as described above. In the present embodiment, then acoustic characteristics of the corrected audio signal may be further corrected so that the audio signal has a target characteristic that are to be a reference. In other words, each of the filter signal processing units 320 and 370 of the respective speakers 32 to 37 may be configured to include the speaker characteristic adding processing unit 314 of the filter signal processing unit 310.

In this case, first, the audio signal output from the left and right door woofers 32 and 33 is subjected to the first process that allows impulse response characteristics close to an impulse and amplitude-frequency characteristics to be obtained by the inverse filter processing units 322 and 332. The corrected audio signal obtained by the first process is subjected to the second process that allows the audio signal to be corrected to be close to a target characteristic by the speaker characteristic adding processing unit 314. This makes it possible to achieve reproduction faithful to original sound and accurate sound localization by a natural reproduced sound in which variations in the output due to the pitch of sound are eliminated, and it is also possible to achieve desired acoustic characteristics of a speaker. The door tweeters 34 and 35 and the door squawkers 36 and 37 may be also performed similarly as described above.

[4.4. Example (Correction of Acoustic Characteristics by Audio Signal Processing Device)]

Figure 16:
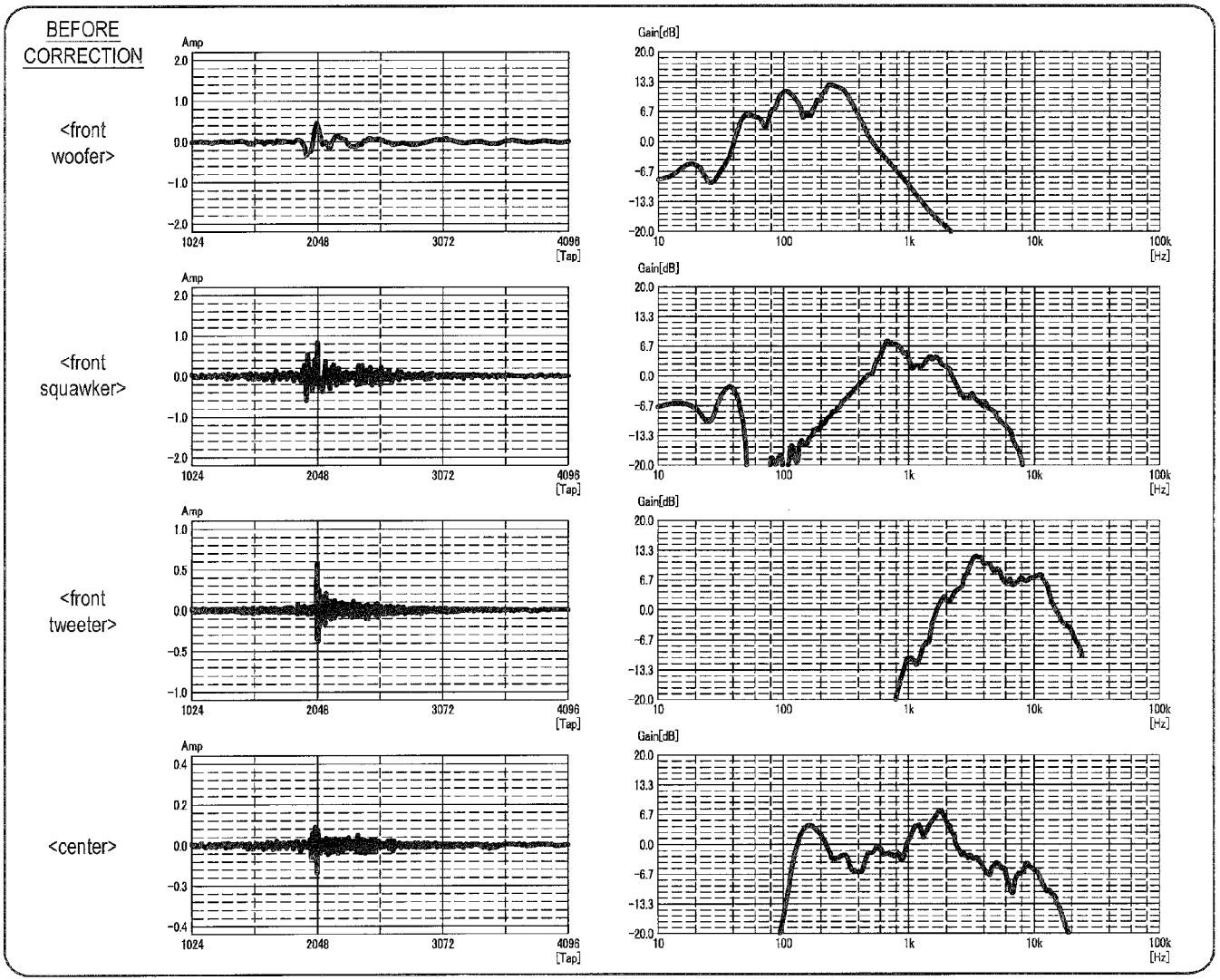
FIG. 16 is a graph showing the impulse response characteristics and amplitude-frequency characteristics before correction by an audio signal process according to the fourth embodiment.
Figure 17:
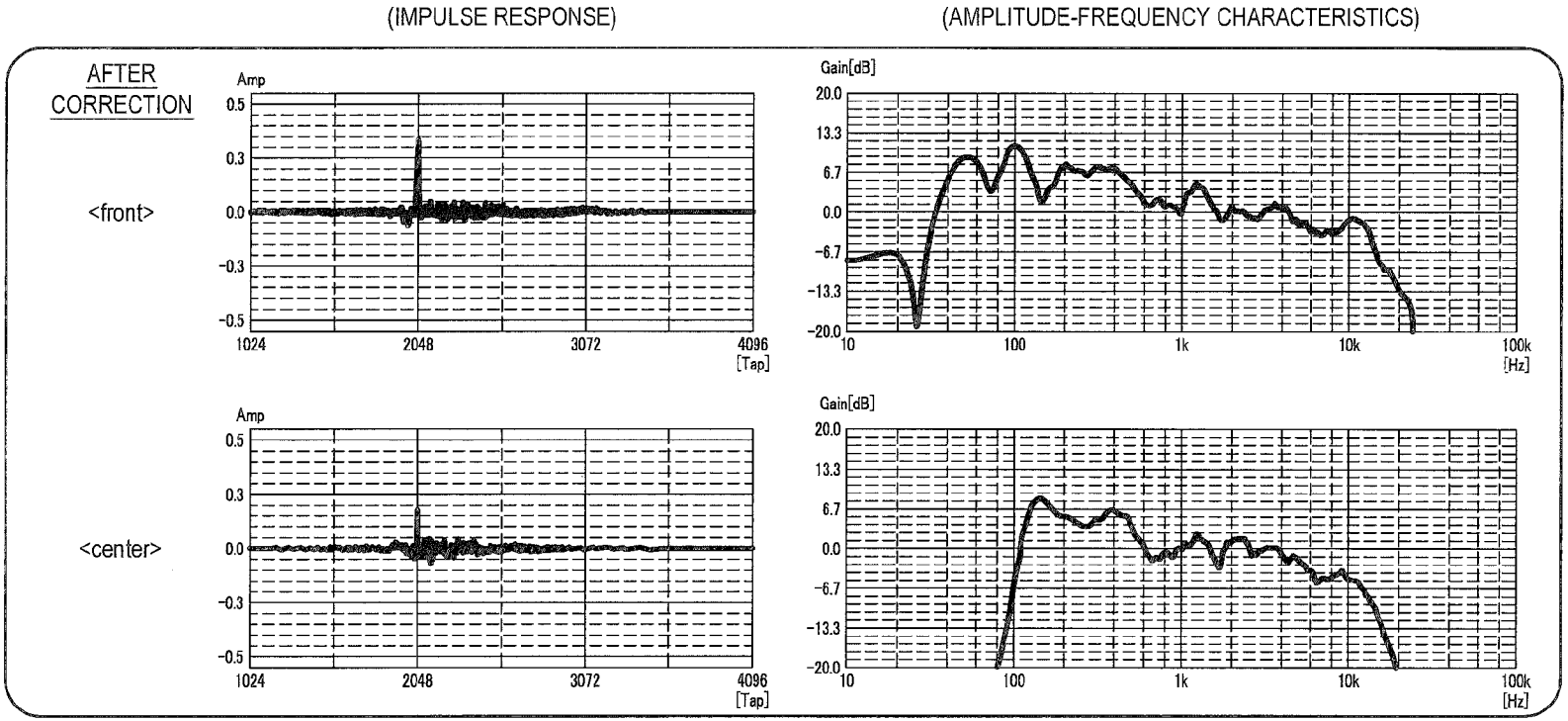
FIG. 17 is a graph showing the impulse response characteristics and amplitude-frequency characteristics after correction by an audio signal process according to the fourth embodiment.

Referring to FIGS. 16 and 17, an example of results obtained by measuring acoustic characteristics at a listening point on the driver's seat side in a case of employing the audio signal processing device 300 according to the present embodiment is described. FIG. 16 shows the impulse response characteristics and amplitude-frequency characteristics of the audio signal output from the left and right door woofers 32 and 33 before the correction (FRONT WOOFER), the impulse response characteristics and amplitude-frequency characteristics of the audio signal output from the left and right door tweeters 34 and 35 before the correction (FRONT TWEETER), the impulse response characteristics and amplitude-frequency characteristics of the audio signal output from the left and right door squawkers 36 and 37 before the correction (FRONT SQUAWKER), and the impulse response characteristics and amplitude-frequency characteristics of the audio signal output from the center speaker 31 before the correction (CENTER). FIG. 17 shows the impulse response characteristics and amplitude-frequency characteristics of the combined audio signal of the left and right door woofers 32 and 33, the left and right door tweeters 34 and 35, and the left and right door squawkers 36 and 37 after the correction (FRONT) and shows the impulse response characteristics and amplitude-frequency characteristics of the audio signal output from the center speaker 31 after the correction (CENTER).

As shown in FIGS. 16 and 17, the impulse response characteristics and amplitude-frequency characteristics of the combined audio signal of the left and right door woofers 32 and 33, door tweeters 34 and 35, and door squawkers 36 and 37 and the impulse response characteristics and amplitude-frequency characteristics of the audio signal output from the center speaker 31 have waveforms that are different between before and after the correction. In terms of impulse response, all of the combined audio signal of the left and right door woofers 32 and 33, door tweeters 34 and 35, and door squawkers 36 and 37 and the audio signal output from the center speaker 31 appear to have characteristics that are more close to an impulse. The audio signal of the center speaker 31 has a waveform that is close to the combined audio signal of the left and right door woofers 32 and 33, door tweeters 34 and 35, and door squawkers 36 and 37.

In terms of amplitude-frequency characteristics, in particular, in the frequency range of 300 Hz or more, a waveform of the corrected audio signal of the center speaker 31 is close to that of the corrected combined audio signal of the left and right door woofers 32 and 33, door tweeters 34 and 35, and door squawkers 36 and 37. Thus, their acoustic characteristics are matched with each other by the audio signal processing device 300, and it can be seen that the acoustic characteristics of the center speaker 31 are close to the acoustic characteristics of the combined audio signal of the left and right door woofers 32 and 33, door tweeters 34 and 35, and door squawkers 36 and 37.

5. Conclusion

As described above, according to one or more embodiments of the present disclosure, in an interior space of a vehicle in which a plurality of speakers having different characteristics are arranged, all the frequencies included in a reproduced sound are allowed to arrive at a listening point in the vicinity of each headrest of the driver's seat and the front passenger seat simultaneously at the same level. This makes it possible to achieve enhanced sound localization.

Although the preferred embodiments of the present disclosure have been described above with reference to the accompanying drawings, the technical scope of the present disclosure is not limited to the above examples. Any person skilled in the field of the present disclosure may find various alterations and modifications within the scope of the appended claims, and it should be understood that they will naturally come under the technical scope of the present disclosure.

Note that the advantages mentioned herein are to be considered illustrative or exemplary rather than restrictive. The technology according to the embodiments of the present disclosure can provide other advantages apparent to those skilled in the art from the description given herein, in addition to or as an alternative to the above advantages.

Additionally, the present technology may also be configured as below.

(1) An audio signal processing device for setting, upon outputting audio signals from a left speaker and a right speaker each having an identical amplitude-frequency characteristic and a phase characteristic, and from one center speaker arranged between the left speaker and the right speaker, listening points between the left speaker and the center speaker and between the right speaker and the center speaker, the audio signal processing device including:

an inverse filter processing unit configured to provide inverse characteristics of an amplitude-frequency characteristic and a phase characteristic of the center speaker; and a speaker characteristic adding processing unit configured to correct the amplitude-frequency characteristic and the phase characteristic of an audio signal of the center speaker that have been processed by the inverse filter processing unit in a manner that the processed amplitude-frequency characteristic and the processed phase characteristic correspond to characteristics of the left speaker and the right speaker.

(2) The audio signal processing device according to (1), wherein the center speaker is a speaker for a mid- and high-range.

(3) The audio signal processing device according to (1) or (2), wherein the center speaker outputs a sum of an audio signal output from the left speaker and an audio signal output from the right speaker.

(4) The audio signal processing device according to any one of (1) to (3), wherein the speaker characteristic adding processing unit corrects an audio signal output from each of the left speaker, the right speaker, and the center speaker in a manner that the audio signal has a predetermined amplitude-frequency characteristic and a predetermined phase characteristic.

(5) The audio signal processing device according to any one of (1) to (4), wherein each of the left speaker and the right speaker includes a mid- and low-range speaker and a high-range speaker, and wherein the speaker characteristic adding processing unit corrects an amplitude-frequency characteristic and a phase characteristic of an audio signal of the center speaker in a manner that the amplitude-frequency characteristic and the phase characteristic of the audio signal of the center speaker correspond to combined characteristics of amplitude-frequency characteristics and phase characteristics of the mid- and low-range speaker and the high-range speaker of the left speaker or the right speaker.

(6) The audio signal processing device according to any one of (1) to (4), wherein each of the left speaker and the right speaker includes a low-range speaker, a mid-range speaker, and a high-range speaker, wherein the speaker characteristic adding processing unit corrects an amplitude-frequency characteristic and a phase characteristic of an audio signal of the center speaker in a manner that the amplitude-frequency characteristic and the phase characteristic of the audio signal of the center speaker correspond to combined characteristics of amplitude-frequency characteristics and phase characteristics of the low-range speaker, the mid-range speaker, and the high-range speaker of the left speaker or the right speaker.

(7) The audio signal processing device according to any one of (1) to (6), wherein an audio signal of each speaker is a monaural signal.

(8) The audio signal processing device according to any one of (1) to (7), wherein the audio signal processing device sets a driver's seat and a front passenger seat of a vehicle as listening points and processes an audio signal from each speaker mounted in an interior space of the vehicle.

(9) An audio signal processing method for setting, upon outputting audio signals from a left speaker and a right speaker each having an identical amplitude-frequency characteristic and phase characteristic, and from one center speaker arranged between the left speaker and the right speaker, listening points between the left speaker and the center speaker and between the right speaker and the center speaker by an audio information processing device, the audio signal processing method including:

providing inverse characteristics of an amplitude-frequency characteristic and a phase characteristic of the center speaker; and correcting an amplitude-frequency characteristic and a phase characteristic of an audio signal of the center speaker provided with the inverse characteristics in a manner that the amplitude-frequency characteristic and the phase characteristic of the audio signal of the center speaker correspond to characteristics of the left speaker and the right speaker.

What is claimed is:

1. An audio signal processing device for setting, upon outputting audio signals from a left speaker and a right speaker both having same amplitude-frequency characteristic and a phase characteristic, and from one center speaker arranged between the left speaker and the right speaker, listening points between the left speaker and the center speaker and between the right speaker and the center speaker, the audio signal processing device comprising:

an inverse filter processing unit configured to provide inverse characteristics of an amplitude-frequency characteristic and a phase characteristic of an impulse response of the center speaker; and a speaker characteristic adding processing unit configured to correct the amplitude-frequency characteristic and the phase characteristic of an audio signal of the center speaker that have been processed by the inverse filter processing unit in a manner that the processed amplitude-frequency characteristic and the processed phase characteristic correspond to characteristics of the left speaker and the right speaker.

2. The audio signal processing device according to claim 1, wherein the center speaker is a speaker for a mid- and high-range frequencies.

3. The audio signal processing device according to claim 1, wherein the center speaker is configured to output a sum of an audio signal output from the left speaker and an audio signal output from the right speaker.

4. The audio signal processing device according to claim 1, wherein the speaker characteristic adding processing unit is configured to correct an audio signal output from each of the left speaker, the right speaker, and the center speaker in a manner that the audio signal has a predetermined amplitude-frequency characteristic and a predetermined phase characteristic.

5. The audio signal processing device according to claim 1, wherein each of the left speaker and the right speaker includes a mid- and low-range speaker and a high-range speaker, and wherein the speaker characteristic adding processing unit is configured to correct the amplitude-frequency characteristic and the phase characteristic of the audio signal of the center speaker in a manner that the amplitude-frequency characteristic and the phase characteristic of the audio signal of the center speaker correspond to combined characteristics of amplitude-frequency characteristics and phase characteristics of the mid- and low-range speaker and the high-range speaker of the left speaker or the right speaker.

6. The audio signal processing device according to claim 1, wherein each of the left speaker and the right speaker includes a low-range speaker, a mid-range speaker, and a high-range speaker, wherein the speaker characteristic adding processing unit is configured to correct the amplitude-frequency characteristic and the phase characteristic of the audio signal of the center speaker in a manner that the amplitude-frequency characteristic and the phase characteristic of the audio signal of the center speaker correspond to combined characteristics of amplitude-frequency characteristics and phase characteristics of the low-range speaker, the mid-range speaker, and the high-range speaker of the left speaker or the right speaker.

7. The audio signal processing device according to claim 1, wherein an audio signal of each speaker is a monaural signal.

8. The audio signal processing device according to claim 1, wherein the audio signal processing device is configured to set a driver's seat and a front passenger seat of a vehicle as listening points and process an audio signal from each speaker mounted in an interior space of the vehicle.

9. An audio signal processing method for setting, upon outputting audio signals from a left speaker and a right speaker both having same amplitude-frequency characteristic and phase characteristic, and from one center speaker arranged between the left speaker and the right speaker, listening points between the left speaker and the center speaker and between the right speaker and the center speaker by an audio information processing device, the audio signal processing method comprising:

providing inverse characteristics of an amplitude-frequency characteristic and a phase characteristic of an impulse response of the center speaker; and correcting an amplitude-frequency characteristic and a phase characteristic of an audio signal of the center speaker provided with the inverse characteristics in a manner that the amplitude-frequency characteristic and the phase characteristic of the audio signal of the center speaker correspond to characteristics of the left speaker and the right speaker.

* * * * *